US008049432B2

(12) United States Patent
Taipale et al.

(10) Patent No.: US 8,049,432 B2
(45) Date of Patent: Nov. 1, 2011

(54) MEASUREMENT CIRCUIT FOR AN ELECTRONIC BALLAST

(75) Inventors: Mark S. Taipale, Harleysville, PA (US); Robert C. Newman, Jr., Emmaus, PA (US); Scott E. Rhodes, Sharpsburg, GA (US)

(73) Assignee: Lutron Electronics Co., Inc., Coopersburg, PA (US)

( * ) Notice: Subject to any disclaimer, the term of this patent is extended or adjusted under 35 U.S.C. 154(b) by 652 days.

(21) Appl. No.: 12/205,385

(22) Filed: Sep. 5, 2008

(65) Prior Publication Data

US 2010/0060186 A1 Mar. 11, 2010

(51) Int. Cl.
*H05B 41/24* (2006.01)
*H05B 37/02* (2006.01)

(52) U.S. Cl. ..... 315/282; 315/283; 315/291

(58) Field of Classification Search ..... 315/209 R, 315/224, 225, 226, 239, 276, 282, 283, 291, 315/307, 308
See application file for complete search history.

(56) References Cited

U.S. PATENT DOCUMENTS

| | | | | |
|---|---|---|---|---|
| 4,700,113 | A | 10/1987 | Stupp | |
| 4,873,471 | A | 10/1989 | Dean et al. | |
| 4,952,848 | A * | 8/1990 | Erhardt | 315/307 |
| 5,041,763 | A | 8/1991 | Sullivan et al. | |
| 5,173,643 | A | 12/1992 | Sullivan et al. | |
| 5,399,943 | A * | 3/1995 | Chandrasekaran | 315/219 |
| 5,408,162 | A | 4/1995 | Williams | |
| 5,793,196 | A | 8/1998 | White | |
| 5,841,239 | A | 11/1998 | Sullivan et al. | |
| 5,864,212 | A | 1/1999 | Sullivan et al. | |
| 6,060,843 | A | 5/2000 | Luger et al. | |
| 6,100,647 | A | 8/2000 | Giannopoulos et al. | |
| 6,198,236 | B1 | 3/2001 | O'Neill | |
| 6,356,035 | B1 | 3/2002 | Weng | |
| 6,452,344 | B1 | 9/2002 | MacAdam et al. | |
| 6,522,089 | B1 * | 2/2003 | Duong et al. | 315/308 |
| 6,642,669 | B1 | 11/2003 | MacAdam et al. | |
| 6,674,248 | B2 | 1/2004 | Newman, Jr. et al. | |

(Continued)

FOREIGN PATENT DOCUMENTS

EP 0 078 864 5/1983

(Continued)

OTHER PUBLICATIONS

International Preliminary Report on Patentability dated Mar. 17, 2011 issued in corresponding PCT International Application No. PCT/US2009/003103.

*Primary Examiner* — Thuy Vinh Tran
(74) *Attorney, Agent, or Firm* — Ostrolenk Faber LLP

(57) ABSTRACT

An electronic ballast for driving a gas discharge lamp comprises a measurement circuit for measuring a lamp current flowing through the lamp and a lamp voltage produced across the lamp. The ballast comprises a first winding magnetically coupled to a main transformer of an inverter circuit, and a second winding magnetically coupled to a resonant inductor of a resonant tank circuit. The first and second windings are coupled in series electrical connection to generate a voltage representative of the magnitude of the lamp voltage. The ballast further comprises a current transformer having primary windings coupled in series with the electrodes of the lamp. The measurement circuit integrates the current conducted through secondary windings of the current transformer only during every other half-cycle of the lamp voltage to generate a control signal representative of the magnitude of the lamp current that is in-phase with the lamp voltage.

30 Claims, 16 Drawing Sheets

U.S. PATENT DOCUMENTS

| | | | | |
|---|---|---|---|---|
| 6,876,157 | B2 * | 4/2005 | Henry | 315/219 |
| 7,061,191 | B2 | 6/2006 | Chitta | |
| 7,312,582 | B2 | 12/2007 | Newman, Jr. et al. | |
| 7,321,202 | B2 | 1/2008 | Chitta | |
| 7,564,200 | B2 * | 7/2009 | Ichikawa et al. | 315/308 |
| 2006/0244392 | A1 | 11/2006 | Taipale et al. | |
| 2006/0244395 | A1 | 11/2006 | Taipale et al. | |
| 2007/0132401 | A1 | 6/2007 | Gawrys et al. | |
| 2007/0188111 | A1 | 8/2007 | Taipale | |

FOREIGN PATENT DOCUMENTS

| | | |
|---|---|---|
| EP | 0 259 603 | 3/1988 |
| EP | 0 350 104 | 1/1990 |
| EP | 0 855 850 | 7/1998 |
| EP | 1 022 932 | 7/2000 |
| EP | 1 056 315 | 11/2000 |
| FR | 2 798 246 | 3/2001 |
| WO | WO 2007/138507 | 12/2007 |

* cited by examiner

MEASUREMENT CIRCUIT FOR AN ELECTRONIC BALLAST

BACKGROUND OF THE INVENTION

1. Field of the Invention

The present invention relates to electronic ballasts for gas discharge lamps, such as fluorescent lamps. More specifically, the present invention relates to a two-wire electronic dimming ballast for powering and controlling the intensity of a fluorescent lamp in response to a phase-controlled voltage.

2. Description of the Related Art

The use of gas discharge lamps, such as fluorescent lamps, as replacements for conventional incandescent lamps, has increased greatly over the last several years. Fluorescent lamps typically are more efficient and provide a longer operational life when compared to incandescent lamps. In certain areas, such as California, for example, state law requires certain areas of new construction to be outfitted for the use of fluorescent lamps exclusively.

A gas discharge lamp must be driven by a ballast in order to illuminate properly. The ballast receives an alternating-current (AC) voltage from an AC power source and generates an appropriate high-frequency current for driving the fluorescent lamp. Dimming ballasts, which can control the intensity of a connected fluorescent lamp, typically have at least three connections: to a switched-hot voltage from the AC power source, to a neutral side of the AC power source, and to a desired-intensity control signal, such as a phase-controlled voltage from a standard three-wire dimming circuit. Some electronic dimming ballasts, such as a fluorescent Tu-Wire® dimmer circuit manufactured by Lutron Electronics Co., Inc., only require two connections, e.g., to the phase-controlled voltage from the dimmer circuit and to the neutral side of the AC power source.

Most prior art ballast circuits have typically been designed and intended for use in commercial applications. This has caused most prior art ballasts to be rather expensive and fairly difficult to install and service, and thus not suitable for residential installations. Thus, there is a need for a small, low-cost two-wire electronic dimming ballast, which can be used by the energy-conscious consumer in combination with a fluorescent lamp as a replacement for an incandescent lamp.

SUMMARY OF THE INVENTION

According to an embodiment of the present invention, a lamp current measurement circuit for an electronic ballast for driving a gas discharge lamp comprises a current transformer, which has first and second primary windings and first and second secondary windings magnetically coupled to the first and second primary windings, and a capacitor coupled to conduct first and second currents of the respective first and second secondary windings of the current transformer, such that a voltage produced across the capacitor is representative of the magnitude of lamp current through the lamp that is in-phase with lamp voltage across the lamp. The ballast comprises an inverter circuit operable to convert a substantially DC bus voltage to a high-frequency AC voltage, and a resonant tank circuit having an output and operable to couple the high-frequency AC voltage to the lamp. The first primary winding is adapted to be coupled in series electrical connection between the output of the resonant tank circuit of the ballast and a first electrode of the lamp, while the second primary winding is adapted to be coupled in series electrical connection between the output of the resonant tank circuit and a second electrode of the lamp. The first and second primary windings are coupled such that differential-mode currents in the electrodes are added and common-mode currents in the electrodes are subtracted. The first current of the first secondary winding of the current transformer flows into the capacitor when the lamp current is positive, and the second current of the second secondary winding of the current transformer flows out of the capacitor when the lamp current is negative. The capacitor only conducts the first and second currents of the first and second secondary windings during every other half-cycle of the lamp voltage, such that the voltage produced across the capacitor is representative of the magnitude of the lamp current that is in-phase with the lamp voltage.

According to another embodiment of the present invention, an electronic ballast for driving a gas discharge lamp having first and second electrodes comprises an inverter circuit, a resonant tank circuit, a current transformer, and a lamp current measurement circuit. The inverter circuit converts a substantially DC bus voltage to a high frequency AC voltage, while the resonant tank couples the high-frequency AC voltage to the lamp. The current transformer has first and second primary windings, and first and second secondary windings magnetically coupled to the first and second primary windings. The first primary winding is adapted to be coupled in series electrical connection between the output of the resonant tank circuit and the first electrode of the lamp, while the second primary winding is adapted to be coupled in series electrical connection between the output of the resonant tank circuit and the second electrode of the lamp. The first and second primary windings are coupled such that differential-mode currents in the electrodes are added and common-mode currents in the electrodes are subtracted. The first and second secondary windings are both coupled to a lamp current measurement circuit and conduct respective first and second currents representative of a lamp current flowing from the first electrode to the second electrode the lamp. The lamp current measurement circuit comprises a capacitor coupled such that the first current of the first secondary winding of the current transformer flows into the capacitor when the lamp current is positive, and the second current of the second secondary winding of the current transformer flows out of the capacitor when the lamp current is negative. The capacitor only conducts the first and second currents of the first and second secondary windings during every other half-cycle of a lamp voltage produced across the lamp, such that a voltage produced across the capacitor is representative of the magnitude of the lamp current that is in-phase with the lamp voltage.

A method of measuring a lamp current in an electronic ballast for driving a gas discharge lamp having first and second electrodes is also described herein. The method comprising the steps of: (1) measuring a first current in the first electrode of the lamp; (2) measuring a second current in the second electrode of the lamp; (3) adding the first and second currents in such a way that differential-mode currents in the electrodes are added and common-mode currents in the electrodes are subtracted; and (4) determining the lamp current in response to the step of adding the first and second currents, the lamp current not dependent upon the common-mode currents.

According to another aspect of the present invention, an electronic ballast for driving a gas discharge lamp comprises an inverter circuit including a main transformer, a resonant tank including a resonant inductor, a first winding magnetically coupled to the primary winding of the main transformer of the inverter circuit, and a second winding magnetically coupled to the resonant inductor of the resonant tank circuit. The inverter circuit converts a substantially DC bus voltage to a high-frequency AC voltage, which is provided across a primary winding of the main transformer at an output of the inverter circuit. The resonant inductor is adapted to be coupled between the output of the inverter circuit and the lamp, such that the resonant tank circuit couples the high-frequency AC voltage to the lamp. The first winding generates a first voltage representative of the magnitude of the high-frequency AC voltage at the output of the inverter circuit, while the second winding generates a second voltage representative of the magnitude of a voltage across the resonant inductor. The first and second windings are coupled in series to generate a third voltage representative of a lamp voltage measured across the lamp.

According to another aspect of the present invention, an electronic ballast for driving a gas discharge lamp comprises an inverter circuit having a main transformer having a primary winding coupled across the output of the inverter circuit, a resonant tank circuit, a first winding magnetically coupled to the primary winding of the main transformer of the inverter circuit, and a second winding magnetically coupled to the resonant inductor of the resonant tank circuit. The inverter circuit converts a substantially DC bus voltage to a high-frequency AC voltage provided at an output of the inverter circuit. The resonant tank circuit couples the high-frequency AC voltage to the lamp, and includes a resonant inductor adapted to be coupled between the output of the inverter circuit and the lamp. The first winding generates a first voltage representative of the magnitude of the high-frequency AC voltage at the output of the inverter circuit, while the second winding generates a second voltage representative of the magnitude of a voltage across the resonant inductor. The first and second windings are coupled in series to generate a third voltage representative of a lamp voltage measured across the lamp.

In addition, a method of measuring a lamp voltage in an electronic ballast for driving a gas discharge lamp is described herein. The ballast comprises an inverter circuit for converting a substantially DC bus voltage to a high-frequency AC voltage provided across a primary winding of a transformer, and a resonant tank circuit for coupling the high-frequency AC voltage to the lamp and including a resonant inductor adapted to be coupled between the primary winding of the transformer of the inverter circuit and the lamp. The method comprises the steps of: (1) magnetically coupling a first winding to the primary winding of the transformer of the inverter circuit; (2) magnetically coupling a second winding to the resonant inductor of the resonant tank circuit; (3) generating a first voltage across the first winding, the first voltage representative of the magnitude of the high-frequency AC voltage of the inverter circuit; (4) generating a second voltage across the second winding, the second voltage representative of the magnitude of a voltage across the resonant inductor; and (5) adding the first and second voltages to produce a third voltage representative of a lamp voltage measured across the lamp.

According to another embodiment of the present invention, an electronic ballast for driving a gas discharge lamp comprises a bus capacitor connected across a DC bus voltage, an inverter circuit for receiving the DC bus voltage and for generating a substantially square-wave voltage having a magnitude approximately twice the DC bus voltage, a resonant tank circuit for receiving the square-wave voltage and generating a sinusoidal voltage for driving the lamp, and a measurement circuit for determining the magnitude of a lamp voltage across the lamp. The inverter circuit comprises a transformer having a primary winding comprising first and second winding portions connected at a center tap and having first and second terminals. The bus capacitor is connected between a common point and the center tap. The inverter circuit further comprises first and second switches coupled between the common point and the respective first and second terminals of the primary winding, and a control circuit for controlling the conduction state of the first and second switches. The control circuit provides first and second control signals to control inputs of the first and second switches, respectively, whereby the first and second switches are alternately rendered conductive to cause a current to flow from the bus capacitor through the first and second winding portions thereby generating the substantially square-wave voltage across the primary winding. The measurement circuit determines the magnitude of the lamp voltage by sensing the square-wave voltage and a voltage across the resonant inductor, and determining the magnitude of the lamp voltage as a difference between the magnitude of the square-wave voltage and the magnitude of the voltage across the resonant inductor.

Other features and advantages of the present invention will become apparent from the following description of the invention that refers to the accompanying drawings.

DETAILED DESCRIPTION OF THE INVENTION

Figure 1:
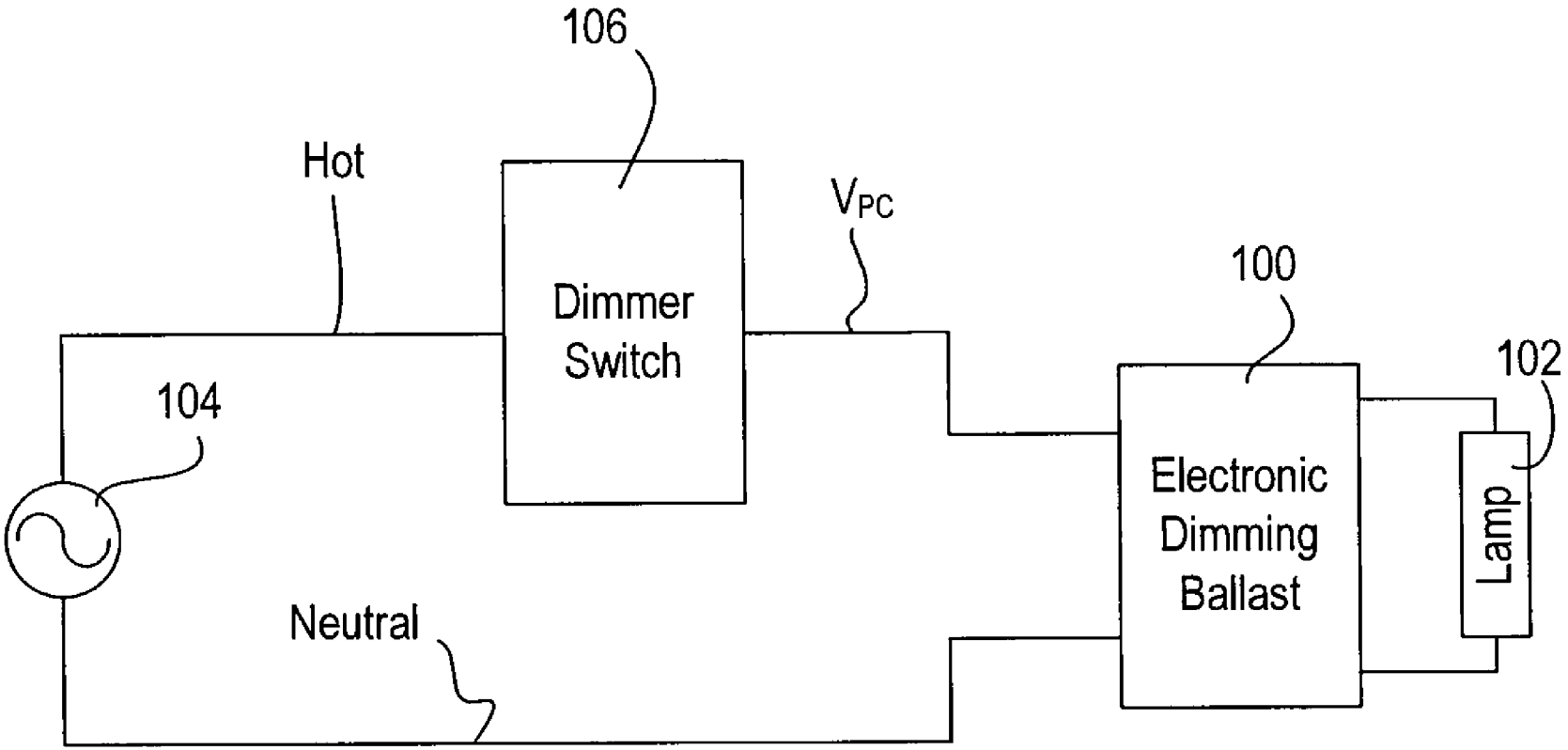
FIG. 1 is a simplified block diagram of a system including an electronic dimming ballast for driving a fluorescent lamp according to a first embodiment of the present invention.

The foregoing summary, as well as the following detailed description of the preferred embodiments, is better understood when read in conjunction with the appended drawings. For the purposes of illustrating the invention, there is shown in the drawings an embodiment that is presently preferred, in which like numerals represent similar parts throughout the several views of the drawings, it being understood, however, that the invention is not limited to the specific methods and instrumentalities disclosed.

FIG. 1 is a simplified block diagram of a system including an electronic dimming ballast 100 for driving a fluorescent lamp 102 according to a first embodiment of the present invention. The ballast 100 is coupled to the hot side of an alternating-current (AC) power source 104 (e.g., 120 $V_{AC}$, 60 Hz) through a conventional two-wire dimmer switch 106. The dimmer switch 106 typically includes a bidirectional semiconductor switch (not shown), such as, for example, a triac or two field-effect transistors (FETs) coupled in anti-series connection, for providing a phase-controlled voltage $V_{PC}$ (i.e., a dimmed-hot voltage) to the ballast 100. Using a standard forward phase-control dimming technique, the bidirectional semiconductor switch is rendered conductive at a specific time each half-cycle of the AC power source and remains conductive for a conduction period $T_{CON}$ during each half-cycle. The dimmer switch 106 is operable to control the amount of power delivered to the ballast 100 by controlling the length of the conduction period $T_{CON}$.

The ballast 100 of FIG. 1 only requires two connections: to the phase-controlled voltage $V_{PC}$ from the dimmer switch 106 and to the neutral side of the AC power source 104. The ballast 100 is operable to control the lamp 102 on and off and to adjust the intensity of the lamp from a low-end (i.e., a minimum intensity) to a high-end (i.e., a maximum intensity) in response to the conduction period $T_{CON}$ of the phase-controlled voltage $V_{PC}$.

Figure 2:
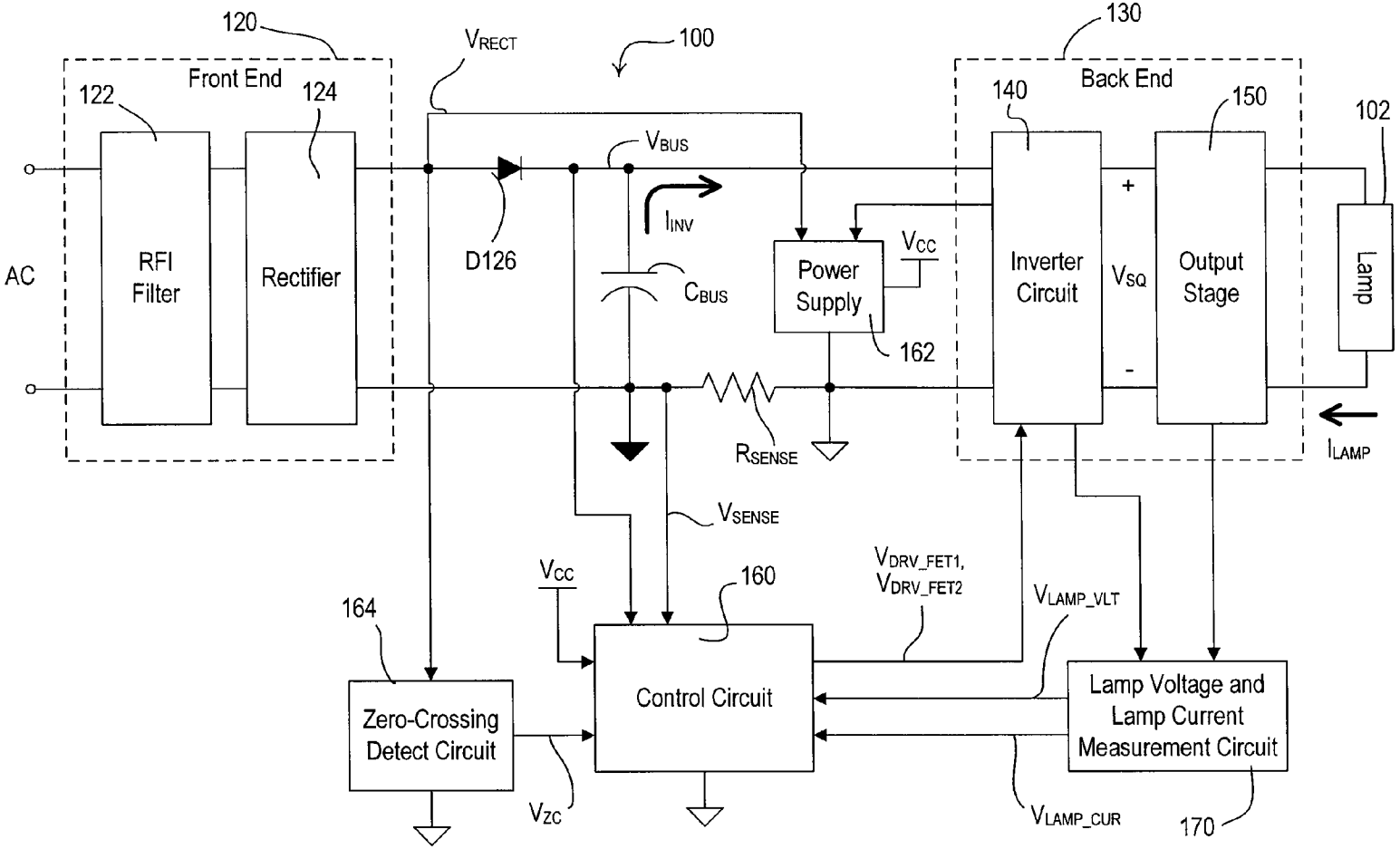
FIG. 2 is a simplified block diagram showing the electronic dimming ballast of FIG. 1 in greater detail.

FIG. 2 is a simplified block diagram showing the electronic dimming ballast 100 in greater detail. The electronic ballast 100 comprises a "front-end" circuit 120 and a "back-end" circuit 130. The front-end circuit 120 includes a radio-frequency interference (RFI) filter 122 for minimizing the noise provided on the AC mains and a full-wave rectifier 124 for receiving the phase-controlled voltage $V_{PC}$ and generating a rectified voltage $V_{RECT}$. The rectified voltage $V_{RECT}$ is coupled to a bus capacitor $C_{BUS}$ through a diode D126 for producing a substantially DC bus voltage $V_{BUS}$ across the bus capacitor $C_{BUS}$. The negative terminal of the bus capacitor $C_{BUS}$ is coupled to a rectifier DC common connection (as shown in FIG. 2).

The ballast back-end circuit 130 includes a power converter, e.g., an inverter circuit 140, for converting the DC bus voltage $V_{BUS}$ to a high-frequency square-wave voltage $V_{SQ}$. The high-frequency square-wave $V_{SQ}$ (i.e., a high-frequency AC voltage) is characterized by an operating frequency $f_{OP}$ (and an operating period $T_{OP}=1/f_{OP}$). The ballast back-end circuit 130 further comprises an output circuit, e.g., a "symmetric" resonant tank circuit 150, for filtering the square-wave voltage $V_{SQ}$ to produce a substantially sinusoidal high-frequency AC voltage $V_{SIN}$, which is coupled to the electrodes of the lamp 102. The inverter circuit 140 is coupled to the negative input of the DC bus capacitor $C_{BUS}$ via a sense resistor $R_{SENSE}$. A sense voltage $V_{SENSE}$ (which is referenced to a circuit common connection as shown in FIG. 2) is produced across the sense resistor $R_{SENSE}$ in response to an inverter current $I_{INV}$ generated through bus capacitor $C_{BUS}$ during the operation of the inverter circuit 140. The sense resistor $R_{SENSE}$ is coupled between the rectifier DC common connection and the circuit common connection and has, for example, a resistance of 1Ω.

The ballast 100 further comprises a control circuit 160, which controls the operation of the inverter circuit 140 and thus the intensity of the lamp 102. A power supply 162 generates a DC supply voltage $V_{CC}$ (e.g., 5 $V_{DC}$) for powering the control circuit 160 and other low-voltage circuitry of the ballast 100.

The control circuit 160 is operable to determine a desired lighting intensity for the lamp 102 (specifically, a target lamp current $I_{TARGET}$) in response to a zero-crossing detect circuit 164. The zero-crossing detect circuit 164 provides a zero-crossing control signal $V_{ZC}$ representative of the zero-crossings of the phase-controlled voltage $V_{PC}$ to the control circuit 160. A zero-crossing is defined as the time at which the phase-controlled voltage $V_{PC}$ changes from having a magnitude of substantially zero volts to having a magnitude greater than a predetermined zero-crossing threshold $V_{TH\text{-}ZC}$ (and vice versa) each half-cycle. Specifically, the zero-crossing detect circuit 164 compares the magnitude of the rectified voltage to the predetermined zero-crossing threshold $V_{TH\text{-}ZC}$ (e.g., approximately 20 V), and drives the zero-crossing control signal $V_{ZC}$ high (i.e., to a logic high level, such as, approximately the DC supply voltage $V_{CC}$) when the magnitude of the rectified voltage $V_{RECT}$ is less than the predetermined zero-crossing threshold $V_{TH\text{-}ZC}$. Further, the zero-crossing detect circuit 164 drives the zero-crossing control signal $V_{ZC}$ low (i.e., to a logic low level, such as, approximately circuit common) when the magnitude of the rectified voltage $V_{RECT}$ is greater than the predetermined zero-crossing threshold $V_{TH\text{-}ZC}$.

The control circuit 160 is operable to determine the target lamp current $I_{TARGET}$ of the lamp 102 in response to the conduction period $T_{CON}$ of the phase-controlled voltage $V_{PC}$. The control circuit 160 is operable to control the peak value of the integral of the inverter current $I_{INV}$ flowing in the inverter circuit 140 to indirectly control the operating frequency $f_{OP}$ of the high-frequency square-wave voltage $V_{SQ}$, and to thus control the intensity of the lamp 102 to the desired lighting intensity.

The ballast 100 further comprises a measurement circuit 170, which provides a lamp voltage control signal $V_{LAMP_VLT}$ and a lamp current control signal $V_{LAMP_CUR}$ to the control circuit 160. The measurement circuit 170 is responsive to the inverter circuit 140 and the resonant tank circuit 150, such that the lamp voltage control signal $V_{LAMP_VLT}$ is representative of the magnitude of a lamp voltage $V_{LAMP}$ measured across the electrodes of the lamp 102, while the lamp current control signal $V_{LAMP_CUR}$ is representative of the magnitude of a lamp current $I_{LAMP}$ flowing through the lamp.

The control circuit 160 is operable to control the operation of the inverter circuit 140 in response to the sense voltage $V_{SENSE}$ produced across the sense resistor $R_{SENSE}$, the zero-crossing control signal $V_{ZC}$ from the zero-crossing detect circuit 164, the lamp voltage control signal $V_{LAMP_VLT}$, and the lamp current control signal $V_{LAMP_CUR}$. Specifically, the control circuit 160 controls the operation of the inverter circuit 140, in order to control the lamp current $I_{LAMP}$ towards the target lamp current $I_{TARGET}$.

Figure 3:
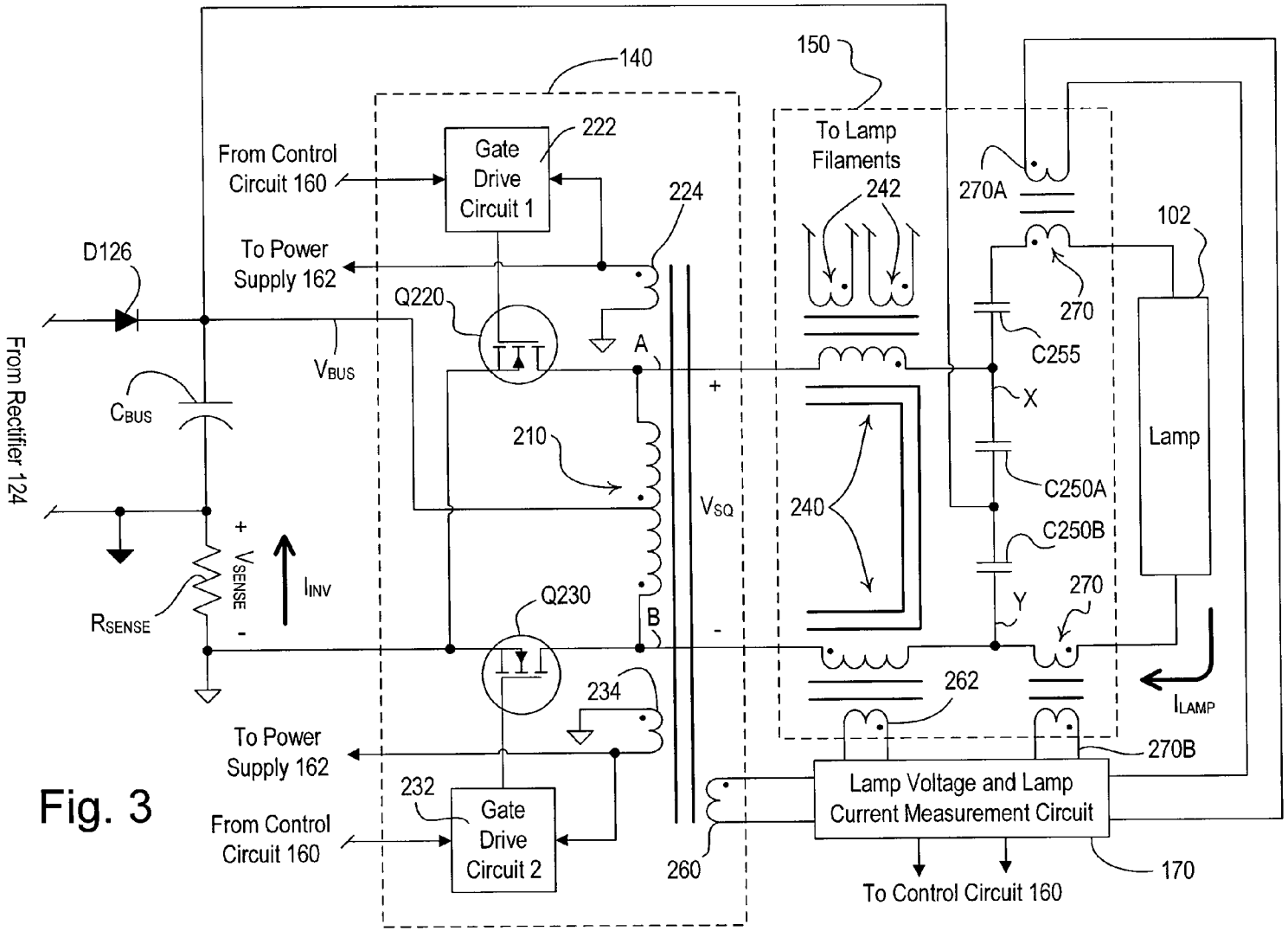
FIG. 3 is a simplified schematic diagram showing a bus capacitor, a sense resistor, an inverter circuit, and a resonant tank of the electronic dimming ballast of FIG. 2 in greater detail.

FIG. 3 is a simplified schematic diagram showing the inverter circuit 140 and the resonant tank circuit 150 in greater detail. As shown in FIG. 3, the inverter circuit 140, the bus capacitor $C_{BUS}$, and the sense resistor $R_{SENSE}$ form a push/pull converter. However, the present invention is not limited to electronic dimming ballasts having only push/pull converters. The inverter circuit 140 comprises a main transformer 210 having a center-tapped primary winding that is coupled across an output of the inverter circuit 140. The high-frequency square-wave voltage $V_{SQ}$ of the inverter circuit 140 is generated across the primary winding of the main transformer 210. The center tap of the primary winding of the main transformer 210 is coupled to the DC bus voltage $V_{BUS}$.

The inverter circuit 140 further comprises first and second semiconductor switches, e.g., field-effect transistors (FETs) Q220, Q230, which are coupled between the terminal ends of the primary winding of the main transformer 210 and circuit common. The FETs Q220, Q230 have control inputs (i.e., gates), which are coupled to first and second gate drive circuits 222, 232, respectively, for rendering the FETs conductive and non-conductive. The gate drive circuits 222, 232 receive first and second FET drive signals $V_{DRV_FET1}$ and $V_{DRV_FET2}$ from the control circuit 160, respectively. The gate drive circuits 222, 232 are also electrically coupled to respective drive windings 224, 234 that are magnetically coupled to the primary winding of the main transformer 210.

The push/pull converter of the ballast 100 exhibits a partially self-oscillating behavior since the gate drive circuits 222, 232 are operable to control the operation of the FETs Q220, Q230 in response to control signals received from both the control circuit 160 and the main transformer 210. Specifically, the gate drive circuits 222, 232 are operable to turn on (i.e., render conductive) the FETs Q220, Q230 in response to the control signals from the drive windings 224, 234 of the main transformer 210, and to turn off (i.e., render non-conductive) the FETs in response to the control signals (i.e., the first and second FET drive signals $V_{DRV_FET1}$ and $V_{DRV_FET2}$) from the control circuit 160. The FETs Q220, Q230 may be rendered conductive on an alternate basis, i.e., such that the first FET Q220 is not conductive when the second FET Q230 is conductive, and vice versa.

Figure 6:
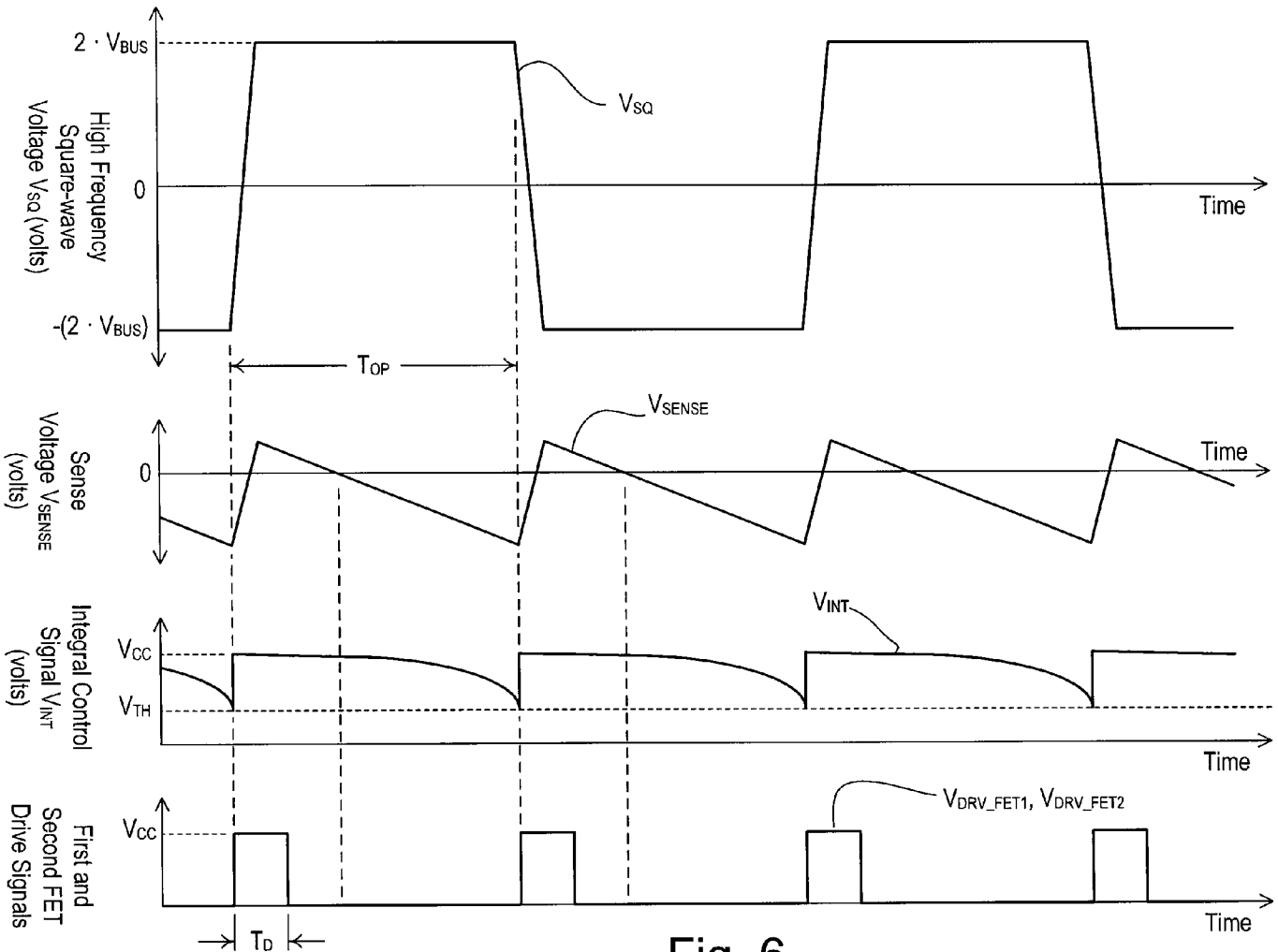
FIG. 6 is a simplified diagram of waveforms showing the operation of the push/pull converter and the control circuit of the ballast of FIG. 2 during normal operation.

When the first FET Q220 is conductive, the terminal end of the primary winding connected to the first FET Q220 is electrically coupled to circuit common. Accordingly, the DC bus voltage $V_{BUS}$ is provided across one-half of the primary winding of the main transformer 210, such that the high-frequency square-wave voltage $V_{SQ}$ at the output of the inverter circuit 140 (i.e., across the primary winding of the main transformer 210) has a magnitude of approximately twice the bus voltage (i.e., $2 \cdot V_{BUS}$) with a positive voltage potential present from node B to node A as shown on FIG. 3. When the second FET Q230 is conductive and the first FET Q230 is not conductive, the terminal end of the primary winding connected to the second FET Q220 is electrically coupled to circuit common. The high-frequency square-wave voltage $V_{SQ}$ at the output of the inverter circuit 140 has an opposite polarity than when the first FET Q220 is conductive (i.e., a positive voltage potential is now present from node A to node B). Accordingly, the high-frequency square-wave voltage $V_{SQ}$ has a magnitude of twice the bus voltage $V_{BUS}$ that changes polarity at the operating frequency of the inverter circuit (as shown in FIG. 6).

As shown in FIG. 3, the drive windings 224, 234 of the main transformer 210 are also coupled to the power supply 162, such that the power supply is operable to draw current to generate the DC supply voltage $V_{CC}$ from the drive windings during normal operation of the ballast 110. When the ballast 100 is first powered up, the power supply 162 draws current from the output of the rectifier 124 through a high impedance path (e.g., approximately 50 kΩ) to generate an unregulated supply voltage $V_{UNREG}$. The power supply 162 does not generate the DC supply voltage $V_{CC}$ until the magnitude of the unregulated supply voltage $V_{UNREG}$ has increased to a predetermined level (e.g., 12 V) to allow the power supply to draw a small amount of current to charge properly during startup of the ballast 100. During normal operation of the ballast 100 (i.e., when the inverter circuit 140 is operating normally), the power supply 162 draws current to generate the unregulated supply voltage $V_{UNREG}$ and the DC supply voltage $V_{CC}$ from the drive windings 224, 234 of the inverter circuit 140. The unregulated supply voltage $V_{UNREG}$ has a peak voltage of approximately 15 V and a ripple of approximately 3 V during normal operation. The power supply 162 also generates a second DC supply voltage $V_{CC2}$, which has a magnitude greater than the DC supply voltage $V_{CC}$ (e.g., approximately 15 $V_{DC}$).

The high-frequency square-wave voltage $V_{SQ}$ is provided to the resonant tank circuit 150, which draws a tank current $I_{TANK}$ (FIG. 4) from the inverter circuit 140. The resonant tank circuit 150 includes a "split" resonant inductor 240, which has first and second windings that are magnetically coupled together around a common magnetic core (i.e., an inductor assemblage). The first winding is directly electrically coupled to node A at the output of the inverter circuit 140, while the second winding is directly electrically coupled to node B at the output of the inverter circuit. A "split" resonant capacitor, which is formed by the series combination of two capacitors C250A, C250B (i.e., a capacitor assemblage), is coupled between the first and second windings of the split resonant inductor 240. The junction of the two capacitors C250A, 250B is coupled to the bus voltage $V_{BUS}$, i.e., to the junction of the diode D126, the bus capacitor $C_{BUS}$, and the center tap of the transformer 210. The split resonant inductor 240 and the capacitors C250A, C250B operate to filter the high-frequency square-wave voltage $V_{SQ}$ to produce the substantially sinusoidal voltage $V_{SIN}$ (between node X and node Y) for driving the lamp 102. The sinusoidal voltage $V_{SIN}$ is coupled to the lamp 102 through a DC-blocking capacitor C255, which prevents any DC lamp characteristics from adversely affecting the inverter.

The symmetric (or split) topology of the resonant tank circuit 150 minimizes the RFI noise produced at the electrodes of the lamp 102. The first and second windings of the split resonant inductor 240 are each characterized by parasitic capacitances coupled between the leads of the windings. These parasitic capacitances form capacitive dividers with the capacitors C250A, C250B, such that the RFI noise generated by the high-frequency square-wave voltage $V_{SQ}$ of the inverter circuit 140 is attenuated at the output of the resonant tank circuit 150, thereby improving the RFI performance of the ballast 100.

The first and second windings of the split resonant inductor 240 are also magnetically coupled to two filament windings 242, which are electrically coupled to the filaments of the lamp 102. Before the lamp 102 is turned on, the filaments of the lamp must be heated in order to extend the life of the lamp. Specifically, during a preheat mode before striking the lamp 102, the operating frequency $f_{OP}$ of the inverter circuit 140 is controlled to a preheat frequency $f_{PRE}$, such that the magnitude of the voltage generated across the first and second windings of the split resonant inductor 240 is substantially greater than the magnitude of the voltage produced across the capacitors C250A, C250B. Accordingly, at this time, the filament windings 242 provide filament voltages to the filaments of the lamp 102 for heating the filaments. After the filaments are heated appropriately, the operating frequency $f_{OP}$ of the inverter circuit 140 is controlled such that the magnitude of the voltage across the capacitors C250A, C250B increases until the lamp 102 strikes and the lamp current $I_{LAMP}$ begins to flow through the lamp.

The measurement circuit 170 is electrically coupled to a first auxiliary winding 260 (which is magnetically coupled to the primary winding of the main transformer 210) and to a second auxiliary winding 262 (which is magnetically coupled to the first and second windings of the split resonant inductor 240). The voltage generated across the first auxiliary winding 260 is representative of the magnitude of the high-frequency square-wave voltage $V_{SQ}$ of the inverter circuit 140, while the voltage generated across the second auxiliary winding 262 is representative of the magnitude of the voltage across the first and second windings of the split resonant inductor 240. Since the magnitude of the lamp voltage $V_{LAMP}$ is approximately equal to the sum of the high-frequency square-wave voltage $V_{SQ}$ and the voltage across the first and second windings of the split resonant inductor 240, the measurement circuit 170 is operable to generate the lamp voltage control signal $V_{LAMP_VLT}$ in response to the voltages across the first and second auxiliary windings 260, 262.

The high-frequency sinusoidal voltage $V_{SIN}$ generated by the resonant tank circuit 150 is coupled to the electrodes of the lamp 102 via a current transformer 270. Specifically, the current transformer 270 has two primary windings which are coupled in series with each of the electrodes of the lamp 102. The current transformer 270 also has two secondary windings 270A, 270B that are magnetically coupled to the two primary windings, and electrically coupled to the measurement circuit 170. The measurement circuit 170 is operable to generate the lamp current $I_{LAMP}$ control signal in response to the currents generated through the secondary windings 270A, 270B of the current transformer 270.

Figure 4:
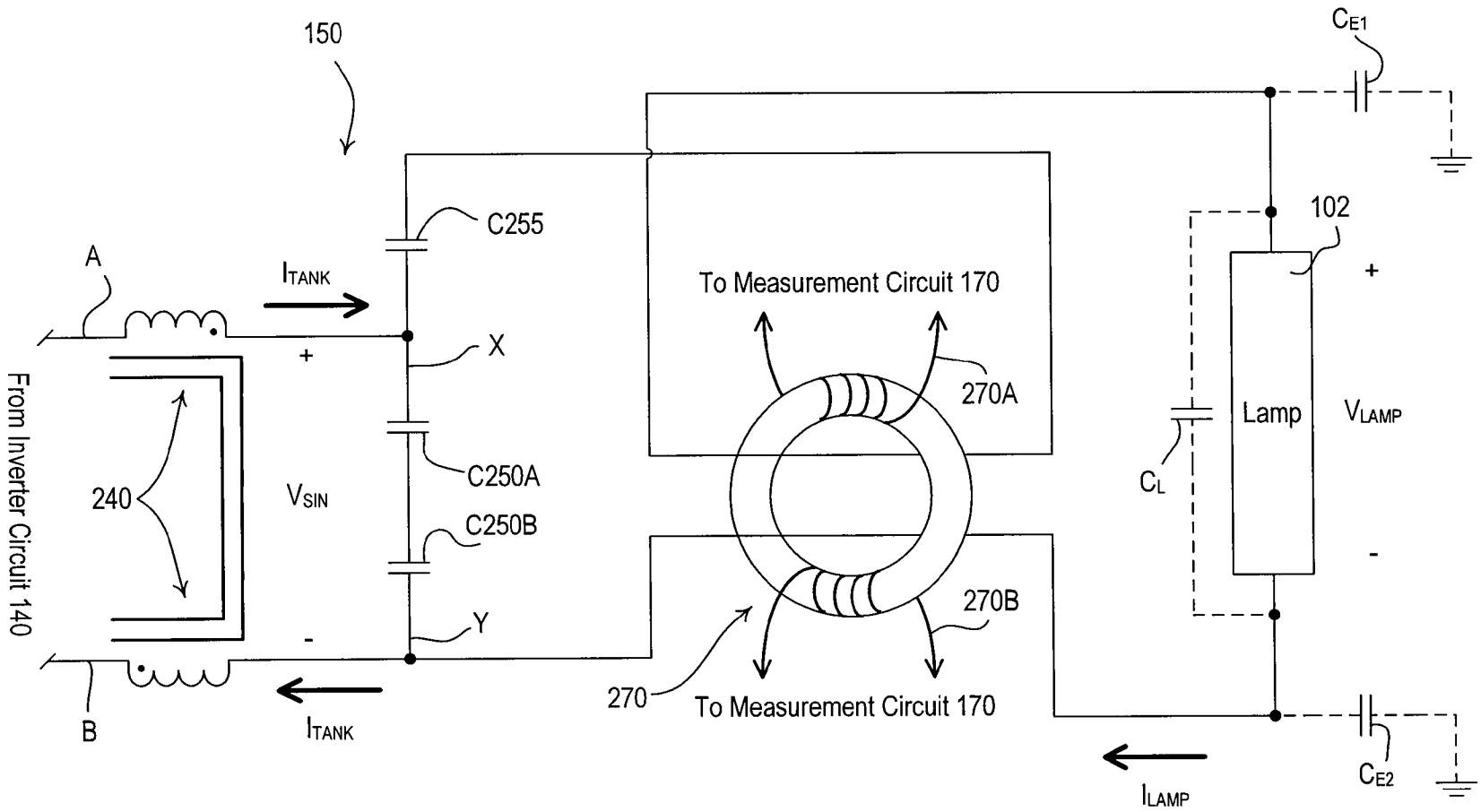
FIG. 4 is a simplified schematic diagram showing a current transformer of the resonant tank of FIG. 3 in greater detail.

FIG. 4 is a simplified schematic diagram showing the current transformer 270 and the connections of the current transformer to the components of the resonant tank circuit 150 and the electrodes of the lamp 102 in greater detail. The lamp 102 is typically characterized by a capacitive coupling $C_{E1}$, $C_{E2}$ between each of the electrodes and earth ground, e.g., the junction box in which the ballast 100 is mounted or the fixture in which the lamp 102 is installed (i.e., a conductive housing of the ballast 100 that is connected to earth ground). These capacitive couplings $C_{E1}$, $C_{E2}$ generate common-mode currents flowing through the primary windings of the current transformer 270. The differential-mode currents flowing through the primary windings of the current transformer 270 are representative of the magnitude of the lamp current $I_{LAMP}$ flowing through the lamp 102 and thus the intensity of the lamp. Therefore, the primary windings of the current transformer 270 are coupled in series with each of the electrodes of the lamp 102 as shown in FIG. 4, such that differential-mode currents in the electrodes of the lamp are added and common-mode currents in the electrodes are subtracted. While current transformer 270 is shown having two primary windings and two secondary windings, the current transformer could alternatively be implemented as two separate transformers, each having one primary winding and one secondary winding.

The operation of the measurement circuit 170 to generate the lamp voltage control signal $V_{LAMP_VLT}$ and the lamp current control signal $V_{LAMP_CUR}$ in response to the currents through the secondary windings 270A, 270B of the current transformer 270 is described in greater detail below with reference to FIG. 7.

Figure 5:
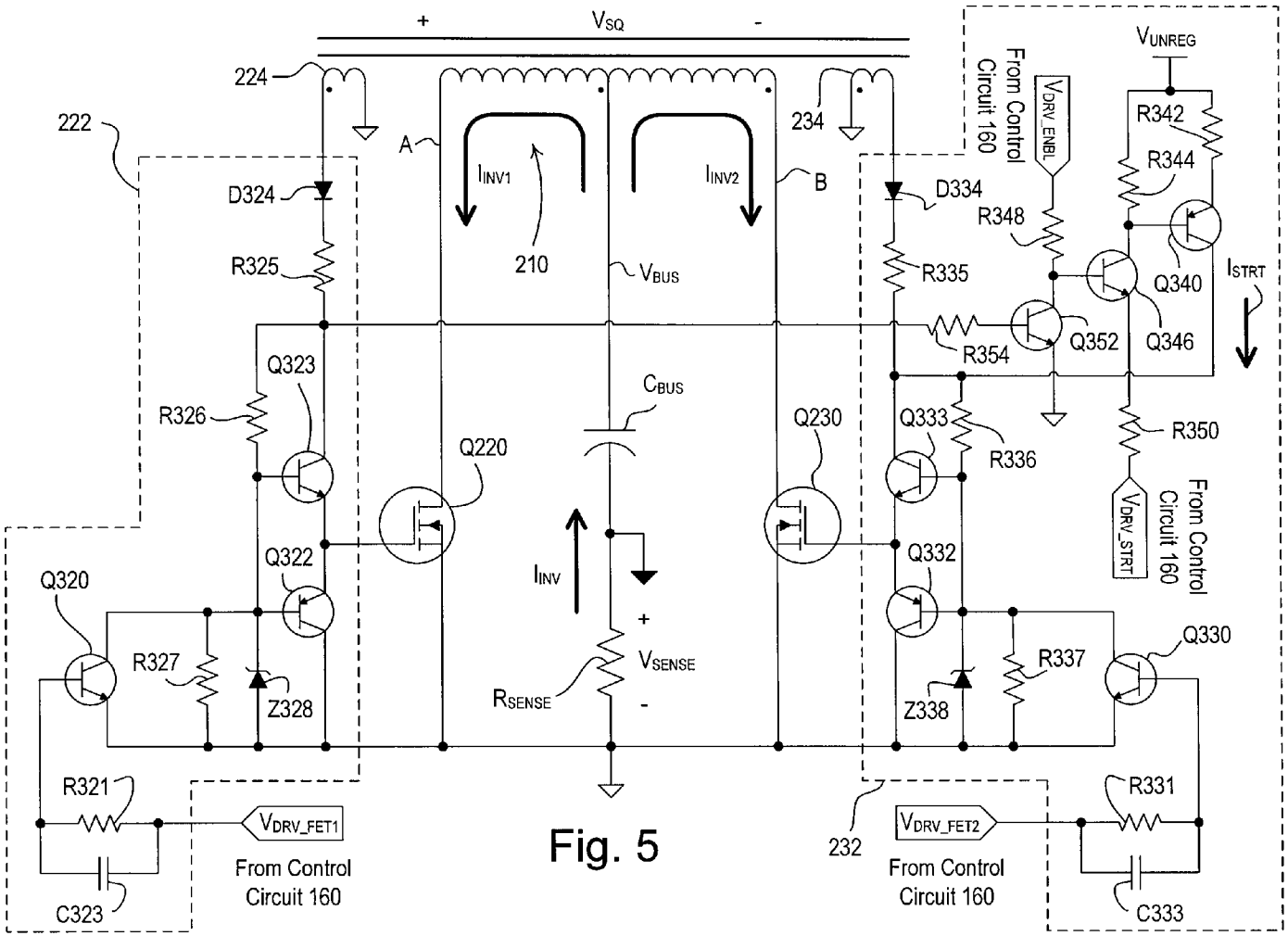
FIG. 5 is a simplified schematic diagram showing in greater detail a push/pull converter, which includes the inverter circuit, the bus capacitor, and the sense resistor of FIG. 3.

FIG. 5 is a simplified schematic diagram of the push/pull converter (i.e., the inverter circuit 140, the bus capacitor $C_{BUS}$, and the sense resistor $R_{SENSE}$) showing the gate drive circuits 222, 232 in greater detail. FIG. 6 is a simplified diagram of waveforms showing the operation of the push/pull converter during normal operation of the ballast 100.

As previously mentioned, the first and second FETs Q220, Q230 are rendered conductive in response to the control signals provided from the first and second drive windings 224, 234 of the main transformer 210, respectively. The first and second gate drive circuits 222, 232 are operable to render the FETs Q220, Q230 non-conductive in response to the first and second FET drive signals $V_{DRV_FET1}$, $V_{DRV_FET2}$ generated by the control circuit 160, respectively. The control circuit 160 drives the first and second FET drive signals $V_{DRV_FET1}$, $V_{DRV_FET2}$ high and low simultaneously, such that the first and second FET drive signals are the same. Accordingly, the FETs Q220, Q230 are non-conductive at the same time, but are conductive on an alternate basis, such that the square-wave voltage is generated with the appropriate operating frequency $f_{OP}$.

When the second FET Q230 is conductive, the tank current $I_{TANK}$ flows through a first half of the primary winding of the main transformer 210 to the resonant tank circuit 150 (i.e., from the bus capacitor $C_{BUS}$ to node A as shown in FIG. 5). At the same time, a current $I_{INV2}$ (which has a magnitude equal to the magnitude of the tank current) flows through a second half of the primary winding (as shown in FIG. 5). Similarly, when the first FET Q220 is conductive, the tank current $I_{TANK}$ flows through the second half of the primary winding of the main transformer 210, and a current $I_{INV1}$ (which has a magnitude equal to the magnitude of the tank current) flows through the first half of the primary winding. Accordingly, the inverter current $I_{INV}$ has a magnitude equal to approximately twice the magnitude of the tank current $I_{TANK}$.

When the first FET Q220 is conductive, the magnitude of the high-frequency square wave voltage $V_{SQ}$ is approximately twice the bus voltage $V_{BUS}$ as measured from node B to node A. As previously mentioned, the tank current $I_{TANK}$ flows through the second half of the primary winding of the main transformer 210, and the current $I_{INV1}$ flows through the first half of the primary winding. The sense voltage $V_{SENSE}$ is generated across the sense resistor $R_{SENSE}$ and is representative of the magnitude of the inverter current $I_{INV}$. Note that the sense voltage $V_{SENSE}$ is a negative voltage when the inverter current $I_{INV}$ flows through the sense resistor $R_{SENSE}$ in the direction of the inverter current $I_{INV}$ shown in FIG. 5.

The control circuit 160 generates an integral control signal $V_{INT}$, which is representative of the integral of the sense voltage $V_{SENSE}$, and is operable to turn off the first FET Q220 in response to the integral control signal $V_{INT}$ reaching a threshold voltage $V_{TH}$ (as will be described in greater detail with reference to FIG. 9). The first FET drive signal $V_{DRV_FET1}$ is coupled to the gate of an NPN bipolar junction transistor Q320 via the parallel combination of a resistor R321 (e.g., having a resistance of 10 kΩ) and a capacitor C323 (e.g., having a capacitance of 100 pF). To turn off the first FET Q220, the control circuit 160 drives the first FET drive signal $V_{DRV_FET1}$ high (i.e., to approximately the DC supply voltage $V_{CC}$). Accordingly, the transistor Q320 becomes conductive and conducts a current through the base of a PNP bipolar junction transistor Q322. The transistor Q322 becomes conductive pulling the gate of the first FET Q220 down towards circuit common, such that the first FET Q220 is rendered non-conductive.

After the FET Q220 is rendered non-conductive, the inverter current $I_{INV}$ continues to flow and charges a drain capacitance of the FET Q220. The high-frequency square-wave voltage $V_{SQ}$ changes polarity, such that the magnitude of the square-wave voltage $V_{SQ}$ is approximately twice the bus voltage $V_{BUS}$ as measured from node A to node B and the tank current $I_{TANK}$ is conducted through the first half of the primary winding of the main transformer 210. Eventually, the drain capacitance of the first FET Q220 charges to a point at which circuit common is at a greater magnitude than node B of the main transformer, and the body diode of the second FET Q230 begins to conduct, such that the sense voltage $V_{SENSE}$ briefly is a positive voltage.

The control circuit 160 drives the second FET drive signal $V_{DRV_FET2}$ low to allow the second FET Q230 to become conductive after a "dead time", and while the body diode of the second FET Q230 is conductive and there is substantially no voltage developed across the second FET Q230 (i.e., only a "diode drop" or approximately 0.5-0.7V). The control circuit 160 waits for a dead time period $T_D$ (e.g., approximately 0.5 μsec) after driving the first and second FET drive signals $V_{DRV_FET1}$, $V_{DRV_FET2}$ high before the control circuit 160 drives the first and second FET drive signals $V_{DRV_FET1}$, $V_{DRV_FET2}$ low in order to render the second FET Q230 conductive while there is substantially no voltage developed across the second FET (i.e., during the dead time). The magnetizing current of the main transformer 210 provides additional current for charging the drain capacitance of the FET Q220 to ensure that the switching transition occurs during the dead time.

Specifically, the second FET Q230 is rendered conductive in response to the control signal provided from the second drive winding 234 of the main transformer 210 after the first and second FET drive signals $V_{DRV_FET1}$, $V_{DRV_FET2}$ are driven low. The second drive winding 234 is magnetically coupled to the primary winding of the main transformer 210, such that the second drive winding 234 is operable to conduct a current into the second gate drive circuit 232 through a diode D334 when the square-wave voltage $V_{SQ}$ has a positive voltage potential from node A to node B. Thus, when the first and second FET drive signals $V_{DRV_FET1}$, $V_{DRV_FET2}$ are driven low by the control circuit 160, the second drive winding 234 conducts current through the diode D334 and resistors R335, R336, R337, and an NPN bipolar junction transistor Q333 is rendered conductive, thus, rendering the second FET Q230 conductive. The resistors R335, R336, R337 have, for example, resistances of 50Ω, 1.5Ω, and 33 kΩ, respectively. A zener diode Z338 has a breakover voltage of 15 V, for example, and is coupled to the transistors Q332, Q333 to prevent the voltage at the bases of the transistors Q332, Q333 from exceeding approximately 15 V.

Since the square-wave voltage $V_{SQ}$ has a positive voltage potential from node A to node B, the body diode of the second FET Q230 eventually becomes non-conductive. The current $I_{INV2}$ flows through the second half of the primary winding and through the drain-source connection of the second FET Q230. Accordingly, the polarity of the sense voltage $V_{SENSE}$ changes from positive to negative as shown in FIG. 6. When the integral control signal $V_{INT}$ reaches the voltage threshold $V_{TH}$, the control circuit 160 once again renders both of the FETs Q220, Q230 non-conductive. Similar to the operation of the first gate drive circuit 222, the gate of the second FET Q230 is then pulled down through two transistors Q330, Q332 in response to the second FET drive signal $V_{DRV_FET2}$. After the second FET Q230 becomes non-conductive, the tank current $I_{TANK}$ and the magnetizing current of the main transformer 210 charge the drain capacitance of the second FET Q230 and the square-wave voltage $V_{SQ}$ changes polarity. When the first FET drive signal $V_{DRV_FET1}$ is driven low, the first drive winding 224 conducts current through a diode D324 and three resistors R325, R326, R327 (e.g., having resistances of 50Ω, 1.5 kΩ, and 33 kΩ, respectively). Accordingly, an NPN bipolar junction transistor Q323 is rendered conductive, such that the first FET Q220 becomes conductive. The push/pull converter continues to operate in the partially self-oscillating fashion in response to the first and second drive signals $V_{DRV_FET1}$, $V_{DRV_FET2}$ from the control circuit 160 and the first and second drive windings 224, 234.

During startup of the ballast 100, the control circuit 160 is operable to enable a current path to conduct a startup current $I_{STRT}$ through the resistors R336, R337 of the second gate drive circuit 232. In response to the startup current $I_{STRT}$, the second FET Q230 is rendered conductive and the inverter current $I_{INV1}$ begins to flow. The second gate drive circuit 232 comprises a PNP bipolar junction transistor Q340, which is operable to conduct the startup current $I_{STRT}$ from the unregulated supply voltage $V_{UNREG}$ through a resistor R342 (e.g., having a resistance of 100Ω). The base of the transistor Q340 is coupled to the unregulated supply voltage $V_{UNREG}$ through a resistor R344 (e.g., having a resistance of 330Ω).

The control circuit 160 generates a FET enable control signal $V_{DRV_ENBL}$ and an inverter startup control signal $V_{DRV_STRT}$, which are both provided to the inverter circuit 140 in order to control the startup current $I_{STRT}$. The FET enable control signal $V_{DRV_ENBL}$ is coupled to the base of an NPN bipolar junction transistor Q346 through a resistor R348 (e.g., having a resistance of 1 kΩ). The inverter startup control signal $V_{DRV_STRT}$ is coupled to the emitter of the transistor Q346 through a resistor R350 (e.g., having a resistance of 220Ω). The inverter startup control signal $V_{DRV_STRT}$ is driven low by the control circuit 160 at startup of the ballast 100. The FET enable control signal $V_{DRV_ENBL}$ is the complement of the first and second drive signals $V_{DRV_FET1}$, $V_{DRV_FET2}$, i.e., the FET enable control signal $V_{DRV_ENBL}$ is driven high when the first and second drive signals $V_{DRV_FET1}$, $V_{DRV_FET2}$ are low (i.e., the FETs Q220, Q230 are conductive). Accordingly, when the inverter startup control signal $V_{DRV_STRT}$ is driven low during startup and the FET enable control signal $V_{DRV_ENBL}$ is driven high, the transistor Q340 is rendered conductive and conducts the startup current $I_{STRT}$ through the resistors R336, R337 and the inverter current $I_{INV}$ begins to flow. Once the push/pull converter is operating in the partially self-oscillating fashion described above, the control circuit 160 disables the current path that provides the startup current $I_{STRT}$.

Another NPN transistor Q352 is coupled to the base of the transistor Q346 for preventing the transistor Q346 from being rendered conductive when the first FET Q220 is conductive. The base of the transistor Q352 is coupled to the junction of the resistors R325, R326 and the transistor Q323 of the first gate drive circuit 222 through a resistor R354 (e.g., having a resistance of 10 kΩ). Accordingly, if the first drive winding 224 is conducting current through the diodes D324 to render the first FET Q220 conductive, the transistor Q340 is prevented from conducting the startup current $I_{STRT}$.

Figure 7:
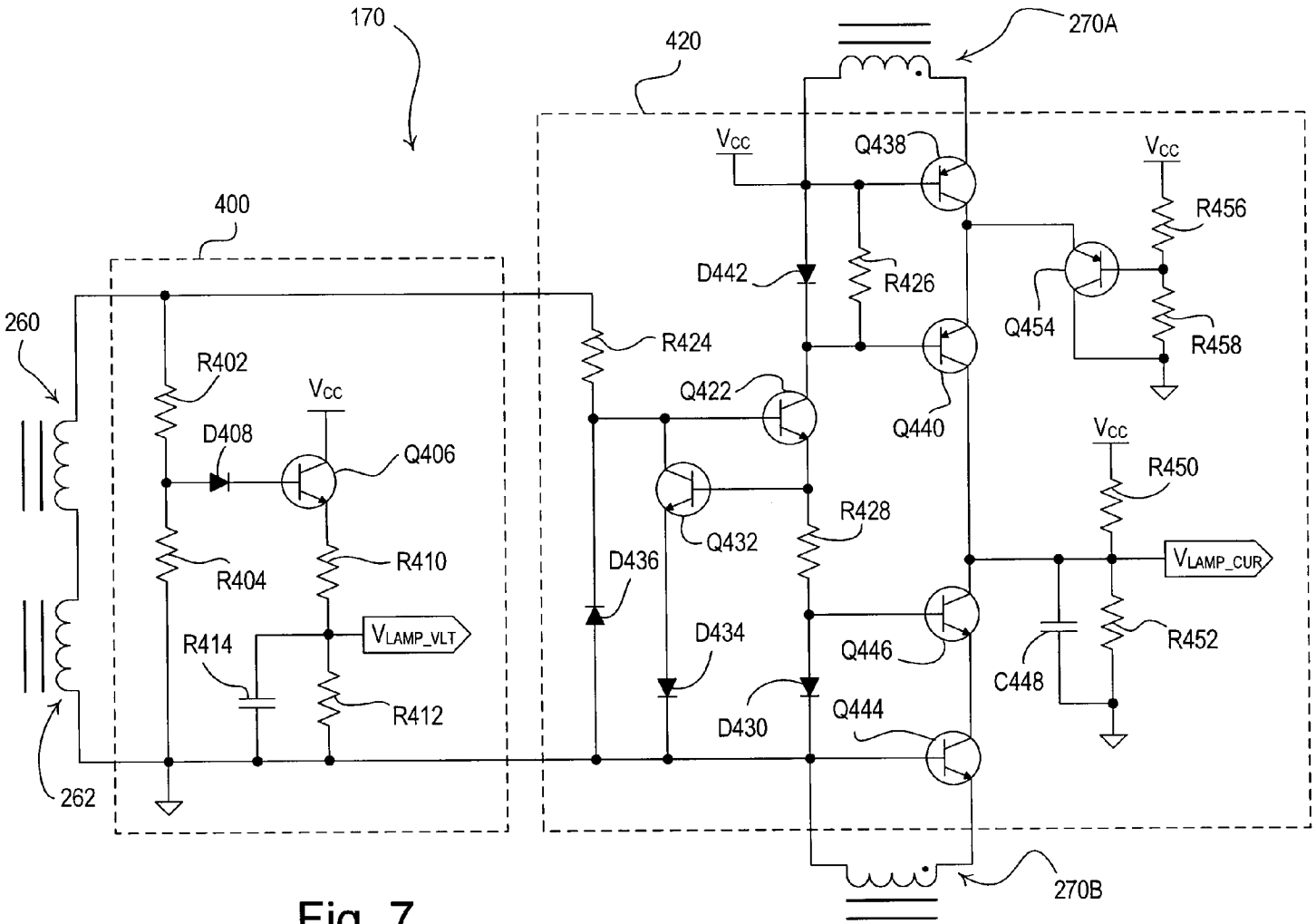
FIG. 7 is a simplified schematic diagram of a measurement circuit of the ballast of FIG. 2 for measuring a lamp voltage and a lamp current of the fluorescent lamp.

FIG. 7 is a simplified schematic diagram of the measurement circuit 170, which comprises a lamp voltage measurement circuit 400 and a lamp current measurement circuit 420. The lamp voltage measurement circuit 400 is coupled to the series combination of the first and second auxiliary windings 260, 262, such that the magnitude of the voltage across the series combination of the auxiliary windings is representative of the magnitude of the lamp voltage $V_{LAMP}$. The lamp voltage measurement circuit 400 generates the lamp voltage control signal $V_{LAMP_VLT}$, such that the lamp voltage control signal has a magnitude approximately equal to the peak of the lamp voltage $V_{LAMP}$. The control circuit 160 determines when an overvoltage condition exits across the lamp 102, i.e., when the voltage across the auxiliary windings 260, 262 exceeds a predetermined overvoltage threshold $V_{OVP}$, in response to the lamp voltage control signal $V_{LAMP_VLT}$. The control circuit 160 then causes the inverter circuit 140 to stop generating the high-frequency square-wave voltage $V_{SQ}$ in response to the lamp voltage control signal $V_{LAMP_VLT}$ to provide overvoltage protection (OVP) for the resonant tank circuit 150.

The lamp voltage measurement circuit 400 comprises two resistors R402, R404, which are coupled in series across the series combination of the auxiliary windings 260, 262, and have, for example, resistances of 320 kΩ and 4.3 kΩ, respectively. The junction of the resistors R402, R404 is coupled to the base of an NPN bipolar junction transistor Q406 through a diode D408. When the voltage across the series-combination of the auxiliary windings 260, 262 rises above the overvoltage threshold $V_{OVP}$, the transistor Q406 conducts current through two resistors R410, R412, and charges a capacitor C414 to generate the lamp voltage control signal $V_{LAMP_VLT}$ across the parallel combination of the resistor R412 and the capacitor C414. For example, the resistors R410, R412 have resistances of 100Ω and 47Ω, respectively, and the capacitor C414 has a capacitance of 0.01 μF.

Figure 8:
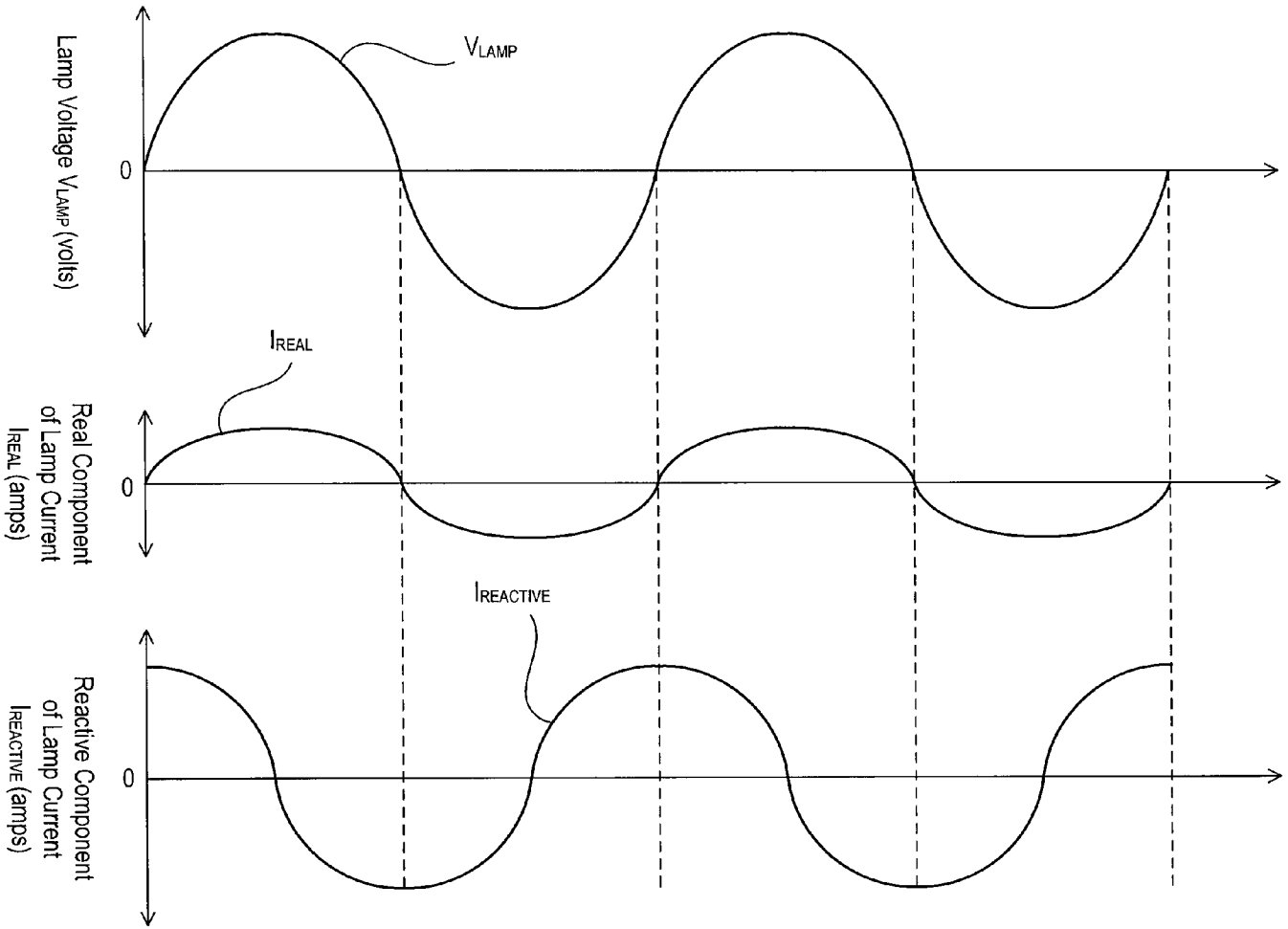
FIG. 8 is a simplified diagram showing the lamp voltage, a real component of the lamp current, and a reactive component of the lamp current of the fluorescent lamp.

The lamp current measurement circuit 420 is coupled to the secondary windings 270A, 270B of the current transformer 270. As shown in FIG. 4, the lamp 102 is characterized by a parasitic capacitance $C_L$ coupled between the electrodes, which causes the lamp current $I_{LAMP}$ to have a reactive component $I_{REACTIVE}$, such that $$I_{LAMP}=I_{REAL}+I_{REACTIVE}, \quad \text{(Equation 1)}$$

where $I_{REAL}$ is the real component of the lamp current. FIG. 8 is a simplified diagram showing the lamp voltage $V_{LAMP}$, the real component $I_{REAL}$ of the lamp current $I_{LAMP}$, and the reactive component $I_{REACTIVE}$ of the lamp current. The reactive component $I_{REACTIVE}$ of the lamp current $I_{LAMP}$ is 90° out of phase with the real component $I_{REAL}$. Since the real component $I_{REAL}$ is representative of the intensity of the lamp 102, the lamp current measurement circuit 420 integrates the currents generated through the secondary windings of the current transformer 270 during every other half-cycle of the lamp voltage $V_{LAMP}$ to determine the magnitude of the real component $I_{REAL}$ of the lamp current $I_{LAMP}$. Because the real component $I_{REAL}$ is in phase with the lamp voltage $V_{LAMP}$ and the reactive component $I_{REACTIVE}$ is 90° out of phase with the real lamp voltage $V_{LAMP}$, the integral of the reactive component $I_{REACTIVE}$ during a half-cycle of the lamp voltage $V_{LAMP}$ is equal to approximately zero amps. Thus, the lamp current control signal $V_{LAMP_CUR}$ generated by the lamp current measurement circuit 420 is representative of only the real component $I_{REAL}$ of the lamp current $I_{LAMP}$.

Since the currents through the secondary windings 270A, 270B of the current transformer 270 are integrated during every other half-cycle of the lamp voltage $V_{LAMP}$, the lamp current measurement circuit 420 is also coupled to the series-combination of the auxiliary windings 260, 262. Specifically, the first auxiliary winding 260 is coupled to the base of an NPN bipolar junction transistor Q422 through a resistor R424, such when the voltage at the base of the transistor Q422 exceeds approximately 1.4 V during the positive half-cycles of the lamp voltage $V_{LAMP}$, the transistor Q422 is rendered conductive. The transistor Q422 then conducts current from the DC supply voltage $V_{CC}$ through resistors R426, R428 and a diode D430 to circuit common. In response to the voltage produced across the resistor R428 and the diode D430, a NPN bipolar junction Q432 conducts current through a diode D434 to limit the current in the transistor Q422. A diode D436 coupled between circuit common and the base of the transistor Q422 prevents the lamp current measurement circuit 420 from being responsive to the lamp current $I_{LAMP}$ during the negative half-cycles of the lamp voltage $V_{LAMP}$.

The first secondary winding 270A of the current transformer 270 is coupled across the base-emitter junction of a PNP bipolar junction transistor Q438. The junction of the base of the transistor Q438 and the secondary winding 270A of the current transformer 270 is coupled to the junction of the diode D426 and the DC supply voltage $V_{CC}$. The secondary winding 270A of the current transformer 270 is electrically coupled such that the transistor Q438 is rendered conductive when the lamp current $I_{LAMP}$ (and thus the current through the winding 270A) has a positive magnitude. When the transistor Q422 is rendered conductive (i.e., during the positive half-cycles of the lamp voltage $V_{LAMP}$) and the transistor Q438 is conductive (i.e., the current through the winding 270A has a positive magnitude), a PNP bipolar junction transistor Q440 is rendered conductive and conducts the current from the secondary winding 270A of the current transformer 270. A diode D442 prevents the voltage at the base of the transistor Q440 from dropping too low, i.e., more than a diode drop (e.g., 0.7 V) below the DC supply voltage $V_{CC}$. When the transistor Q422 is non-conductive, the base of the transistor Q440 is pulled up towards the DC supply voltage $V_{CC}$ through the resistor R426 and the transistor Q440 is rendered non-conductive.

Similarly, the second secondary winding 270B of the current transformer 270 is coupled across the base-emitter junction of an NPN bipolar junction transistor Q444, such that the transistor Q444 is rendered conductive when the lamp current $I_{LAMP}$ has a negative magnitude. Accordingly, when the transistor Q422 is rendered conductive (i.e., during the positive half-cycles of the lamp voltage $V_{LAMP}$) and the transistor Q444 is conductive, another NPN bipolar junction transistor Q446 is rendered conductive and thus conducts the current from the secondary winding 270B.

The lamp current measurement circuit 420 is operable to integrate the current through the secondary windings 270A, 270B of the current transformer 270 using a capacitor C448 (e.g., having a capacitance of 0.1 μF). The lamp current measurement circuit 420 further comprises two resistors R450, R452 (e.g., having resistances of 6.34 kΩ and 681Ω, respectively) coupled in series between the DC supply voltage $V_{CC}$ and circuit common, such that the capacitor C448 is coupled between the junction of the two resistors R450, R452 and circuit common. The collectors of the transistors Q440, Q446, which are coupled together, are coupled to the junction of the capacitor C448 and the two resistors R450, R452. Accordingly, the transistors Q440, Q446 are operable to steer the current through either of the secondary windings 270A, 270B of the current transformer 270 into the capacitor C448 during the positive half-cycles of the lamp voltage $V_{LAMP}$ when the transistor Q422 is conductive. Thus, during the positive half-cycles of the lamp voltage $V_{LAMP}$, the magnitude of the current $I_{C448}$ conducted through the capacitor C448 is representative of the lamp current $I_{LAMP}$, i.e., $$I_{C448}=I_{270A}+I_{270B}=I_{LAMP}, \quad \text{(Equation 2)}$$

where $I_{270A}$ and $I_{270B}$ are the magnitudes of the currents through the secondary windings 270A, 270B of the current transformer 270, respectively, and β is a constant that is dependent upon the number of turns of the current transformer 270. During the negative half-cycles of the lamp voltage $V_{LAMP}$, the magnitude of the current $I_{C448}$ is zero amps.

Since the integral of the reactive component $I_{REACTIVE}$ during the positive half-cycles of the lamp voltage $V_{LAMP}$ is equal to approximately zero amps, the lamp voltage control signal $V_{LAMP_CUR}$ is produced across the capacitor C448 and has a magnitude that is representative of the magnitude of the real component $I_{REAL}$ of the lamp current $I_{LAMP}$, i.e., $$V_{LAMP_CUR}=(1/C_{448})\cdot\int\beta\cdot I_{LAMP}dt=(1/C_{448})\cdot\beta\cdot\int(I_{REAL}+I_{REACTIVE})dt=(\beta/C_{448})\cdot(\int I_{REAL}dt+\int I_{REACTIVE}dt)=(\beta/C_{448})\cdot\int I_{REAL}\,dt, \quad \text{(Equation 3)}$$

where the integration is taken over the positive half-cycles of the lamp voltage $V_{LAMP}$.

The transistors Q422, Q432, Q438, Q440, Q446 of the lamp current measurement circuit 420 operate such that the transistors do not operate in the saturation region, which minimizes the switching times of the transistors (i.e., the time between when one of the transistors is fully conductive and fully non-conductive). The lamp current measurement circuit 420 comprises a PNP bipolar junction transistor Q454 having an emitter coupled to the collector of the transistor Q438. The transistor Q454 has a base coupled to the junction of two resistors R456, R458, which are coupled in series between the DC supply voltage $V_{CC}$ and circuit common. For example, the resistors R456, R458 have resistances of 1 kΩ, and 10 kΩ, respectively, such that the transistor Q454 is non-conductive when the transistor Q440 is conductive. However, when the transistor Q440 is non-conductive, the transistor Q454 conducts current through the transistor Q438 to prevent the transistor Q438 from entering the saturation region during the times when the current through the first secondary winding 270A has a positive magnitude. If the transistor Q438 were to enter the saturation region when the transistor Q440 become conductive, the transistor Q438 would conduct a large unwanted pulse of current through the capacitor C448.

Figure 9:
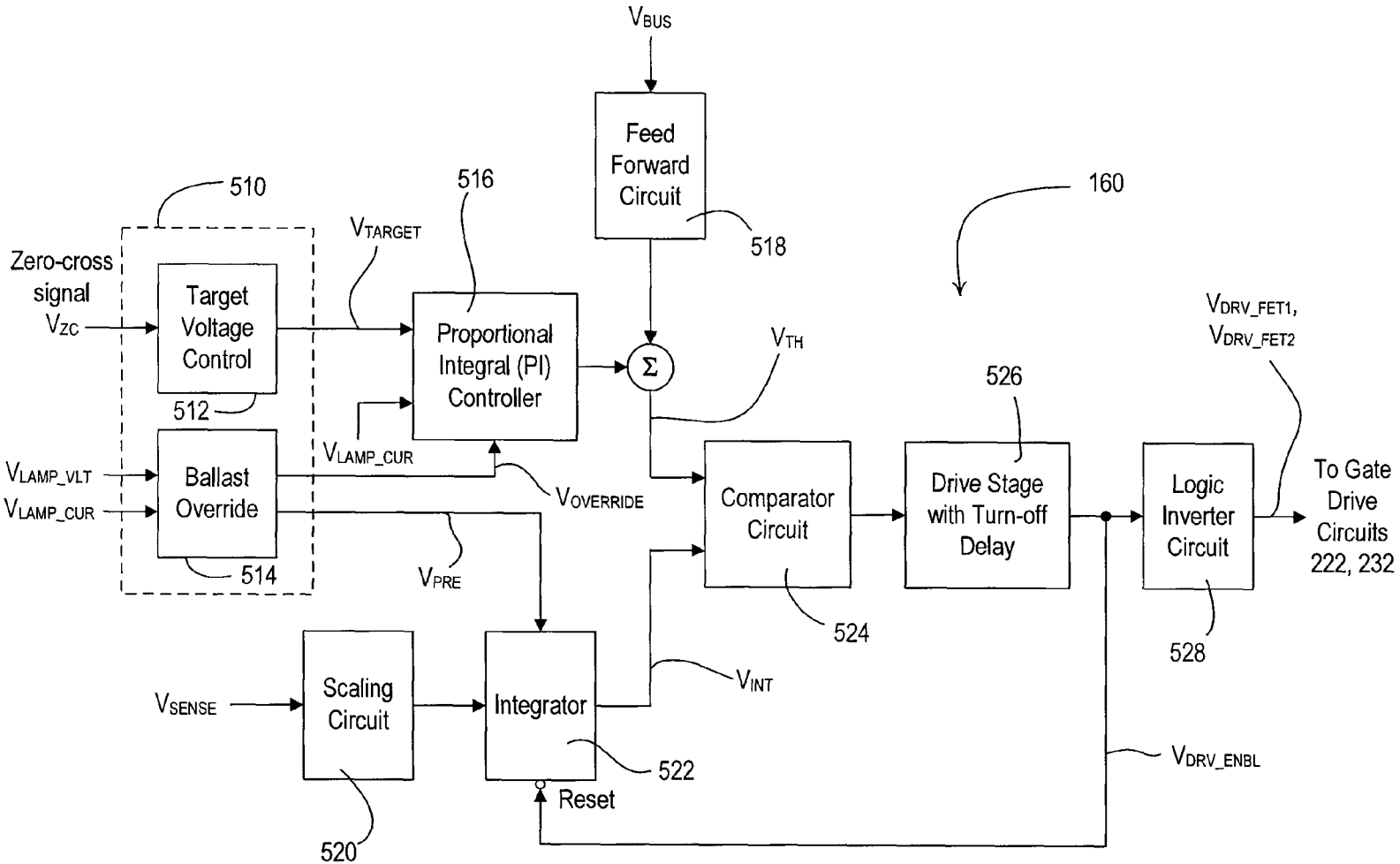
FIG. 9 is a simplified block diagram of a control circuit of the ballast of FIG. 2.
Figure 10A:
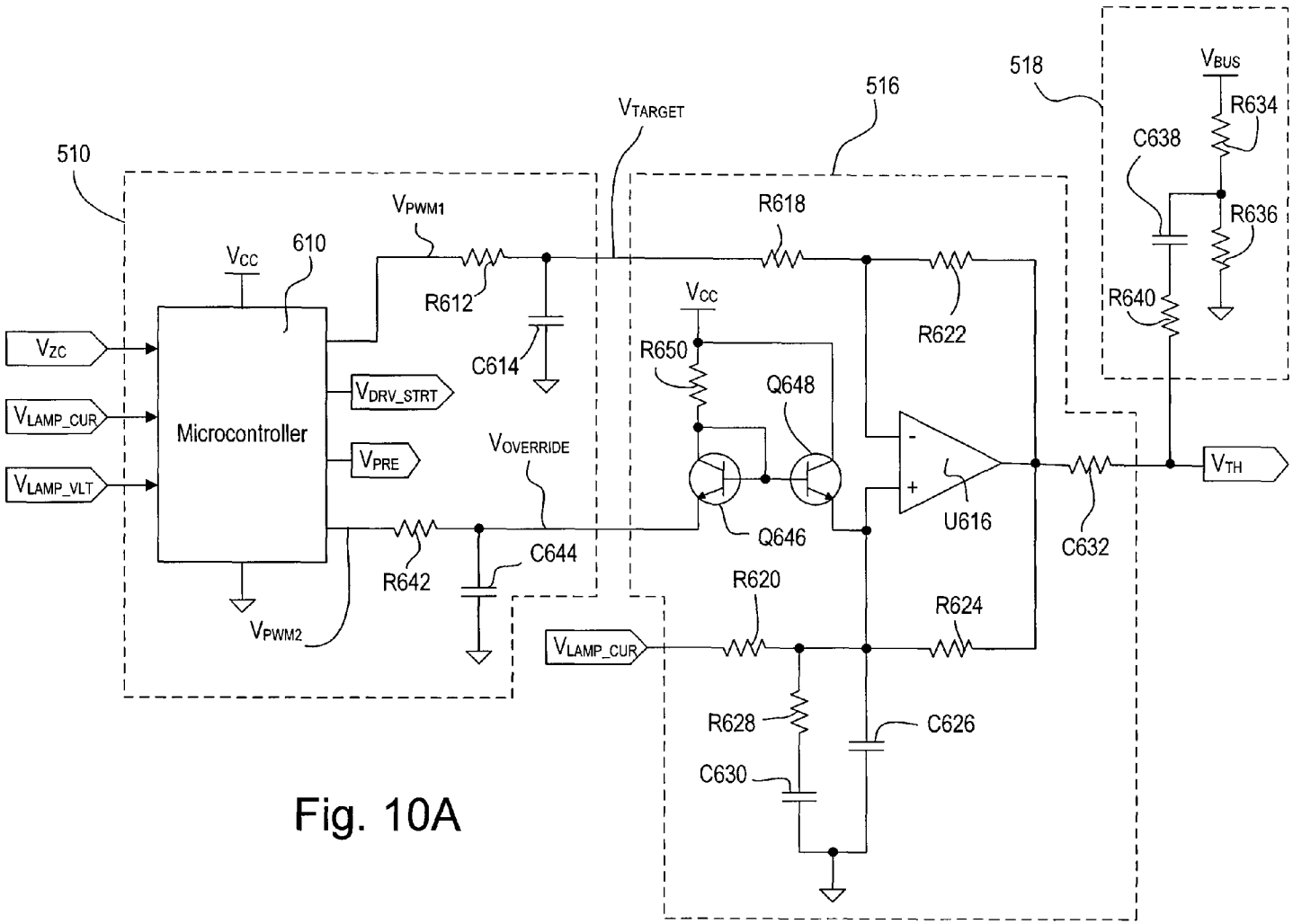
FIGS. 10A and 10B are simplified schematic diagrams of the control circuit of FIG. 9.

FIG. 9 is a simplified block diagram of the control circuit 160. The control circuit 160 includes a digital control circuit 510, which may comprise a microcontroller 610 (FIG. 10A). The digital control circuit 510 performs two functions, which are represented by a target voltage control block 512 and a ballast override control block 514 in FIG. 9. The target voltage control block 512 receives the zero-crossing control signal $V_{ZC}$ from the zero-crossing detector 162, and generates a target voltage $V_{TARGET}$, which has a DC magnitude between circuit common and the DC supply voltage $V_{CC}$ and is representative of the target lamp current $I_{TARGET}$ that results in the desired intensity of the lamp 102. The ballast override control block 514 controls the operation of the ballast 100 during preheating and striking of the lamp 102 and may be used to override the normal operation of the ballast in the occurrence of a fault condition, e.g., an overvoltage condition across the output of the ballast. The ballast override control block 514 is responsive to the lamp voltage $V_{LAMP}$ and the lamp current $I_{LAMP}$, and generates an override control signal $V_{OVERRIDE}$ and a preheat control signal $V_{PRE}$.

The control circuit 160 further comprises a proportional-integral (PI) controller 516, which attempts to minimize the error between target voltage $V_{TARGET}$ and the lamp current control signal $V_{LAMP_CUR}$ (i.e., the difference between the target lamp current $I_{TARGET}$ and the present magnitude of the lamp current $I_{LAMP}$). Step variations of the magnitude of the bus voltage $V_{BUS}$ while the bus capacitor $C_{BUS}$ is recharging may result in step variations in the magnitude of the lamp current $I_{LAMP}$. The control circuit 160 compensates for variations in the bus voltage $V_{BUS}$ by summing the output of the PI controller 516 with a voltage generated by a feed forward circuit 518, which is representative of the instantaneous magnitude of the bus voltage $V_{BUS}$ and has a faster response time than the PI controller. The summing operation generates the threshold voltage $V_{TH}$ to which the integral control signal $V_{INT}$ is compared, thus causing the inverter circuit 140 to switch at the appropriate operating frequency $f_{OP}$ to generate the desired lamp current $I_{LAMP}$ through the lamp 102.

The ballast override control block 514 is operable to override the operation to the PI controller 516 to control the operating frequency $f_{OP}$ to the appropriate frequencies during preheating and striking of the lamp by controlling the override control signal $V_{OVERRIDE}$ to an appropriate DC magnitude (between circuit common and the DC supply voltage $V_{CC}$). During normal operation of the ballast 100, the override control signal $V_{OVERRIDE}$ has a magnitude of zero volts, such that that ballast override control block 514 does not affect the operation of the PI controller 516. If the ballast override control block 514 detects an overvoltage condition at the output of the resonant tank circuit 150, the override control block is operable to control the operating frequency $f_{OP}$ of the lamp 102 to a level such that the lamp current $I_{LAMP}$ is controlled to a minimal current, e.g., approximately zero amps.

The control circuit 160 receives the sense voltage $V_{SENSE}$ generated across the sense resistor $R_{SENSE}$, and is responsive to inverter current $I_{INV}$, which is conducted through the sense resistor. A scaling circuit 520 generates a scaled control signal that is representative of the magnitude of the inverter current $I_{INV}$. The scaled control signal is integrated by an integrator 522 to produce the integral control signal $V_{INT}$, which is compared to the threshold voltage $V_{TH}$ by a comparator circuit 524. A drive stage 526 is responsive to the output of the comparator circuit 524 and generates the FET enable control signal $V_{DRV_ENBL}$. When the integral control signal $V_{INT}$ drops below the threshold voltage $V_{TH}$, the output of the comparator circuit 524 goes high. In response, the drive stage 528 drives the FET enable control signal $V_{DRV_ENBL}$ low, which resets the integrator 522. The drive stage 528 maintains the FET enable control signal $V_{DRV_ENBL}$ low for the dead time period $T_D$ after which the drive stage drives the FET enable control signal high once again. A logic inverter inverts the FET enable control signal $V_{DRV_ENBL}$ to generate the first and second FET drive signals $V_{DRV_FET1}$, $V_{DRV_FET2}$.

Figure 10B:
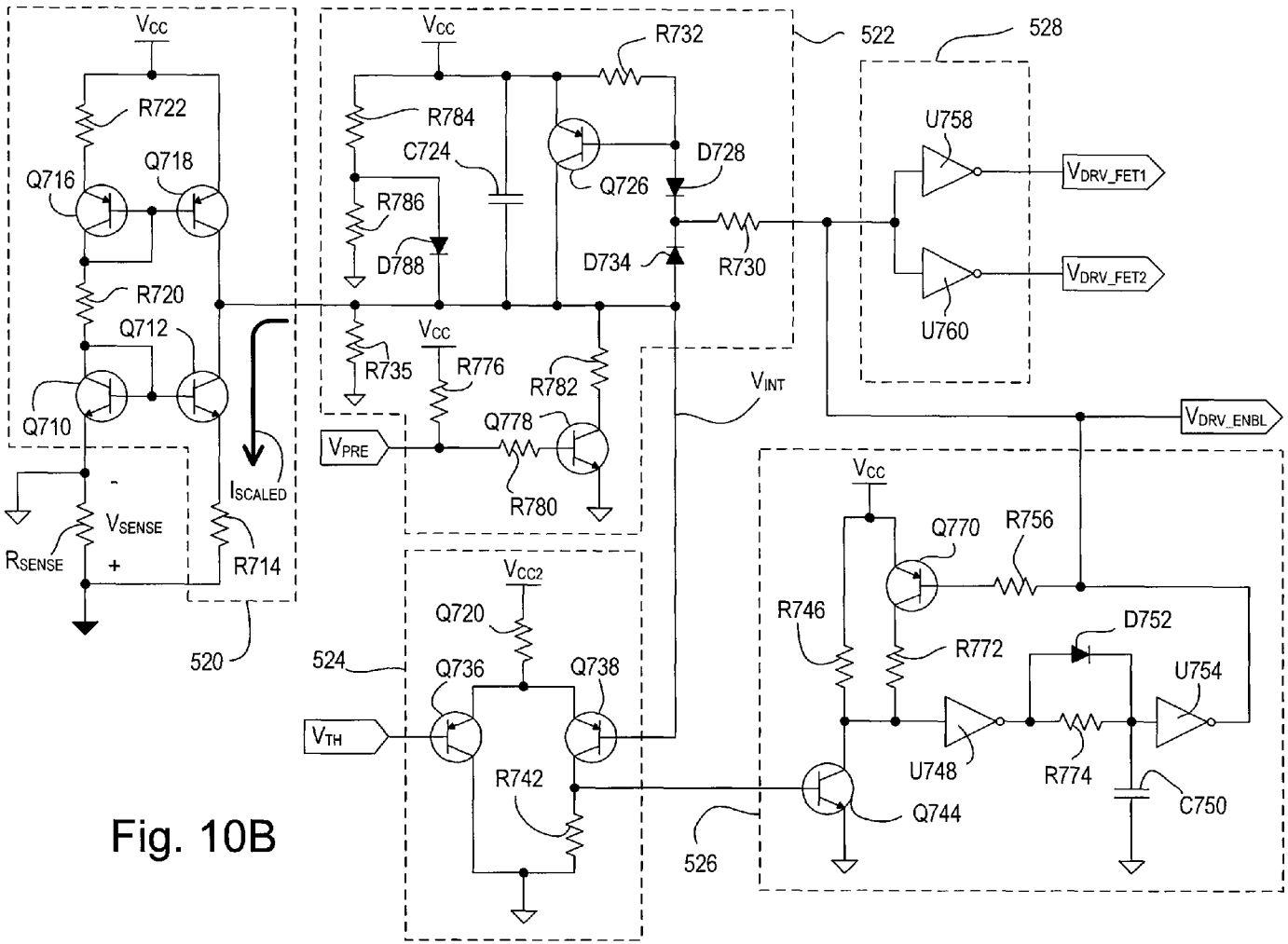

FIGS. 10A and 10B are simplified schematic diagrams of the control circuit 160. As previously mentioned, the digital control circuit 510 comprises the microcontroller 610, which may be implemented as any suitable processing device, such as a programmable logic device (PLD), a microprocessor, or an application specific integrated circuit (ASIC). The microcontroller 610 executes a normal operation procedure 800 and a startup procedure 900, which are described in greater detail with reference to FIGS. 11 and 12, respectively. The microcontroller 610 receives the zero-crossing control signal $V_{ZC}$ and generates a first pulse-width modulated (PWM) signal $V_{PWM1}$, which has a duty cycle dependent upon the target lamp current. The first PWM signal $V_{PWM1}$ is filtered by a resistor-capacitor (RC) circuit to generate the DC target voltage $V_{TARGET}$. The RC circuit comprises a resistor R612 (e.g., having a resistance of 11 kΩ) and a capacitor C614 (e.g., having a capacitance of 1 μF).

The PI controller 516 comprises an operational amplifier (op amp) U616. The target voltage $V_{TARGET}$ is coupled to the inverting input of the op amp U616 through a resistor R618 (e.g., having a resistance of 22 kΩ). The lamp current control signal $V_{LAMP_CUR}$ is coupled to the non-inverting input of the op amp U616 through a resistor R620 (e.g., having a resistance of 33 kΩ). The PI controller 516 comprises two feedback resistors R622, R624, which both have resistances of 33 kΩ, for example. The feedback resistors R622, R624 are coupled between the output of the op amp U616 and the inverting and non-inverting inputs, respectively. A capacitor C626 (e.g., having a capacitance of 1000 pF) is coupled between the non-inverting input of the op amp U616 and circuit common. The series combination of a resistor R628 and a capacitor C630 is coupled in parallel with the capacitor C626. For example, the resistor R628 has a resistance of 10 kΩ, while the capacitor C630 has a capacitance of 0.22 μF. The output of the op amp U616 is coupled in series with a resistor R632 (e.g., having a resistance of 2.2 kΩ).

The PI controller 516 operates to minimize the error $e_i$ between the average of the first PWM signal $V_{PWM1}$ and the lamp current control signal $V_{LAMP_CUR}$, i.e., $$e_i = V_{LAMP_CUR} - \text{avg}[V_{PWM}]. \quad \text{(Equation 4)}$$

For the PI controller 516 as shown in FIG. 10A, the threshold voltage $V_{TH}$ is generated in dependence upon the following equation:

$$V_{TH} = A_P \cdot e_i + A_1 \int e_i \, dt, \quad \text{(Equation 5)}$$

where the values of the constants $A_P$, $A_1$ are determined from the values of the components of the PI controller 516. Accordingly, the magnitude of the threshold voltage $V_{TH}$ is dependent upon the present value of the error $e_1$ and the integral of the error. The output of the PI controller 516, i.e., the threshold voltage $V_{TH}$, is a DC voltage to which the integral control signal $V_{INT}$ is compared. If the lamp current control signal $V_{LAMP_CUR}$ is greater than the average of the first PWM signal $V_{PWM1}$, the PI controller 516 increases the threshold voltage $V_{TH}$, such that the inverter current $I_{INV}$ decreases in magnitude. On the other hand, if the lamp current control signal $V_{LAMP_CUR}$ is less than the average of the first PWM signal $V_{PWM1}$, the PI controller 516 decreases the threshold voltage $V_{TH}$, such that the inverter current $I_{INV}$ increases in magnitude.

The output of the PI controller 516 is modified by the bus voltage $V_{BUS}$ through the feed forward circuit 518. The feed forward circuit 518 includes two resistors R634, R636, which are coupled in series between the bus voltage $V_{BUS}$ and circuit common. A capacitor C638 and a resistor R640 are coupled in series between the junction of the resistors R634, R636 and the output of the PI controller 516. For example, the capacitor C638 has a capacitance of 0.33 μF, while the resistors R634, R636, R640 have resistances of 200 kΩ, 4.7 kΩ, and 1 kΩ, respectively. When the magnitude of the bus voltage $B_{BUS}$ increases, the magnitude of the threshold voltage $V_{TH}$ also increases, thus causing the peak value of the inverter current $I_{INV}$ (and the magnitude of the lamp current $I_{LAMP}$) to decrease. When the magnitude of the bus voltage $V_{BUS}$ decreases, the magnitude of the threshold voltage $V_{TH}$ also decreases, thus causing the peak value of the inverter current $I_{INV}$ (and the magnitude of the lamp current $I_{LAMP}$) to increase. Accordingly, the feed forward circuit 518 helps the control circuit 160 to compensate for ripple in the bus voltage $V_{BUS}$, while maintaining the lamp current $I_{LAMP}$ and the intensity of the lamp 102 substantially constant.

The digital control circuit 510 is operable to override the operation of the PI controller 516 during startup of the ballast 100 and during fault conditions. The digital control circuit 510 is coupled to the non-inverting input of the op amp U616 of the PI controller 516 and is responsive to both the lamp voltage control signal $V_{LAMP_VLT}$ and the lamp current control signal $V_{LAMP_CUR}$. The microcontroller 610 generates a second PWM signal $V_{PWM2}$, which has a duty cycle dependent upon the operating mode of the ballast 110 (i.e., either normal operation, preheat mode, strike mode, or fault condition). To achieve the appropriate operating frequency $f_{OP}$ during startup and fault conditions, the microcontroller 610 controls the threshold voltage $V_{TH}$ to the appropriate levels by controlling the duty cycles of both of the first and second PWM signals $V_{PWM1}$, $V_{PWM2}$. The microcontroller 610 generates the preheat control signal $V_{PRE}$ for controlling the integrator 522 during preheating of the lamp 102, and the inverter startup control signal $V_{DRV_STRT}$ for starting up the operation of the inverter circuit 140 (as previously described with reference to FIG. 5).

The second PWM signal $V_{PWM2}$ is filtered by an RC circuit comprising a resistor R642 (e.g., having a resistance of 10 kΩ) and a capacitor C644 (e.g., having a capacitance of 0.022 μF) to generate the override voltage $V_{OVERRIDE}$. The PI controller 516 comprises a mirror circuit having two NPN bipolar junction transistors Q646, Q648 and a resistor R650 (e.g., having a resistance of 47 kΩ). The mirror circuit is coupled to the non-inverting input of the op amp U616 and receives the override voltage $V_{OVERRIDE}$ from the digital control circuit 510. The mirror circuit ensures that the override voltage $V_{OVERRIDE}$ only appears at the non-inverting input of the op amp U616 of the PI controller 516 if the override voltage exceeds the voltage generated at the non-inverting input of the op amp in response to the lamp current control signal $V_{LAMP_CUR}$.

Referring to FIG. 10B, the scaling circuit 520 is responsive to the magnitude of the sense voltage $V_{SENSE}$ (i.e., responsive to the magnitude of the inverter current $I_{INV}$ of the inverter circuit 140). As shown in FIG. 10B, the scaling circuit 520 comprises, for example, a mirror circuit comprising two NPN bipolar junction transistors Q710, Q712 having bases that are coupled together. A resistor R714 is coupled to the emitter of the transistor Q712, such that a scaled current $I_{SCALED}$ is generated through the resistor R714 when one of the FETs Q220, Q230 is conducting the inverter current $I_{INV}$ (i.e., in the direction of one of the currents $I_{INV1}$, $I_{INV2}$ shown in FIG. 5). The scaled current $I_{SCALED}$ has a magnitude that is representative of the magnitude of the inverter current $I_{INV}$, for example, proportional to the inverter current. Specifically, the resistor R714 has a resistance of approximately 1 kΩ, such that the magnitude of the scaled current $I_{SCALED}$ is equal to approximately 1/1000 of the magnitude of the inverter current $I_{INV}$. The transistors Q710, Q712 may be provided as part of a dual package part (e.g., part number MBT3904DW1, manufactured by ON Semiconductor), such that the operational characteristics of the two transistors are matched as best as possible.

Since the emitter resistances seen by the transistors Q710, Q712 are quite different, the base-emitter voltages of the transistors Q710, Q712 will not be the same. As a result, there is a small bias current conducted through the base of the transistor Q712 even when the magnitude of the sense voltage $V_{SENSE}$ is approximately zero volts. To eliminate this bias current, the scaling circuit 520 comprises a compensation circuit including two PNP bipolar junction transistors Q716, Q718 (which may both be part of a dual package part number MMDT3906, manufactured by ON Semiconductor). The collector of the transistor Q710 is coupled to the collector of the transistor Q716 via a resistor R720 (e.g., having a resistance of 4.7 kΩ), while the collectors of the transistors Q712, Q718 are coupled directly together. The emitter of the transistor Q716 is coupled to the DC supply voltage $V_{CC}$ through a resistor R722 (e.g., having a resistance of 1 kΩ). The transistor Q718 provides a bias current having a magnitude approximately equal to the magnitude of the bias current conducted in the base of the transistor Q712, thus effectively canceling out the bias current.

The integrator 522 is responsive to the scaled current $I_{SCALED}$ and generates the integral control signal $V_{INT}$, which is representative of the integral of the scaled current $I_{SCALED}$ and thus the integral of the inverter current $I_{INV}$ when the inverter current has a positive magnitude. A integration capacitor C724 is the primary integrating element of the integrator 522 and may have a capacitance of approximately 130 pF. The integrator 522 is reset in response to the FET enable control signal $V_{DRV_ENBL}$. Specifically, the voltage across the capacitor C724 is set to approximately zero volts at the same time the FETs Q220, Q230 of the inverter circuit 140 are rendered non-conductive by the control circuit 160. A PNP bipolar junction transistor Q726 is coupled across the capacitor C724. The base of the transistor Q726 is coupled to the FET enable control signal $V_{DRV_ENBL}$ through a diode D728 and a resistor R730 (e.g., having a resistance of 10 kΩ). When the FET enable control signal $V_{DRV_ENBL}$ is pulled low (to turn the FETs Q220, Q230 off), the diode D728 and the resistor R730 conduct current through a resistor R732 (e.g., having a resistance of 4.7 kΩ). When the appropriate voltage is developed across the base-emitter junction of the transistor Q726, the transistor Q726 begins to conduct, thus discharging the capacitor C724 until the voltage across the capacitor C724 is approximately zero volts. A diode D734, which is coupled from the collector of the transistor Q726 and the junction of the diode D728 and the resistor R730, prevents the transistor Q726 from operating in the saturation region.

When the FET enable control signal $V_{DRV_ENBL}$ is once again driven high, the capacitor C724 has an initial voltage of approximately zero volts and the integral control signal $V_{INT}$ has a magnitude equal to approximately the DC supply voltage $V_{CC}$ as shown in FIG. 6. The capacitor C724 begins to charge through a resistor R735 (e.g., having a resistance of 47Ω). When the FETs Q220, Q230 begin to conduct the inverter current $I_{INV}$ (i.e., in the direction of currents $I_{INV1}$, $I_{INV2}$ in FIG. 5), the capacitor C724 begins to charge in response to the scaled current $I_{SCALED}$, which increases in magnitude with respect to time. Accordingly, the integral control signal $V_{INT}$ decreases in magnitude as a function of the integral of the scaled current $I_{SCALED}$ as shown in FIG. 6. The resistor R735 provides a minimum charging current to cause oscillation even when the magnitude of the inverter current $I_{INV}$ is approximately zero amps.

The comparator circuit 524 compares the magnitude of the integral control signal $V_{INT}$ and the magnitude of the threshold voltage $V_{TH}$, and signals to the drive stage 526 when the magnitude of the integral control signal $V_{INT}$ decreases below the magnitude of the threshold voltage $V_{TH}$. The comparator circuit 524 comprises two PNP bipolar junction transistors Q736, Q738 and a resistor R740. The resistor R740 is coupled between the emitters of the transistors Q736, Q738 and the second DC supply voltage $V_{CC2}$ (i.e., 15 V), and may have a resistance of approximately 10 kΩ. When the magnitude of the integral control signal $V_{INT}$ is greater than the magnitude of the threshold voltage $V_{TH}$, the first transistor Q736 is conductive, while the second transistor Q738 is non-conductive. Accordingly, the output of the comparator circuit 524 is pulled down towards circuit common through a resistor R742 (e.g., having a resistance of 4.7 kΩ). When the magnitude of the integral control signal $V_{INT}$ decreases to less than the magnitude of the threshold voltage $V_{TH}$, the second transistor Q738 is rendered conductive, thus pulling the output of the comparator circuit 524 up towards the DC supply voltage $V_{CC}$ (e.g., to approximately 0.7 V).

The drive stage 526 comprises an NPN bipolar junction transistor Q744 and a resistor R746, which is coupled between the collector of the transistor Q744 and the DC supply voltage $V_{CC}$, and has, for example, a resistance of 10 kΩ. When the output of the comparator circuit 524 is pulled up away from circuit common, the transistor Q744 is rendered conductive, thus pulling the input of a first logic inverter Q748 down towards circuit common. Accordingly, the output of the logic inverter Q748 is driven up towards the DC supply voltage $V_{CC}$ and a capacitor C750 quickly charges through a diode D752 to approximately the DC supply voltage $V_{CC}$. The capacitor C750 has, for example, a capacitance of 47 pF. A second logic inverter U754 is coupled to the capacitor C750, such that the FET enable control signal $V_{FET_ENBL}$ is generated at the output of the inverter U754. Accordingly, the FET enable control signal $V_{FET_ENBL}$ is pulled down towards circuit common when the capacitor charges to the DC supply voltage $V_{CC}$.

The logic inverter circuit 528 simply comprises two logic inverters U758, U760, having inputs coupled to the FET enable control signal $V_{FET_ENBL}$. The output of the first logic inverter U758 generates the first FET drive signal $V_{DRV_FET1}$, while the output of the second logic inverter U760 generates the second FET drive signal $V_{DRV_FET2}$.

When the magnitude of the integral control signal $V_{INT}$ drops below the magnitude of the threshold voltage $V_{TH}$, the output of the comparator circuit 524 is pulled up towards the DC supply voltage $V_{CC}$ to render the transistor Q744 conductive. The drive stage 526 then pulls the FET enable control signal $V_{FET_ENBL}$ down towards circuit common, such that the first and second FET drive signals $V_{DRV_FET1}$, $V_{DRV_FET2}$ are driven high, thus rendering the FETs Q220, Q230 of the inverter circuit 140 non-conductive. The drive stage maintains the FET enable control signal $V_{FET_ENBL}$ at the logic high level for the dead time period $T_D$ after which the FETs Q220, Q230 are no longer rendered non-conductive.

Since the integrator 522 is reset (i.e., the magnitude of the integral control signal $V_{INT}$ returns to approximately the DC supply voltage $V_{CC}$) in response to the FET enable control signal $V_{FET_ENBL}$, the output of the comparator circuit 524 is once again pulled low towards circuit common as soon as the FETs Q220, Q230 are rendered non-conductive. The base of a PNP bipolar junction transistor Q770 is coupled to the FET enable control signal $V_{FET_ENBL}$ through a resistor R756 (e.g., having a resistance of 1 kΩ). When the FETs Q220, Q230 are rendered non-conductive, the transistor Q770 is rendered conductive pulling the input of the first logic inverter U748 up towards the DC supply voltage $V_{CC}$ through a resistor R772. The resistor R772 has a smaller resistance than the resistor R746, for example, 220Ω, such that the output of the logic inverter U748 is quickly driven towards circuit common. The capacitor C750 then discharges through a resistor R774. When the capacitor C750 discharges to the appropriate level, the logic inverter U754 drives the output high, such that the FETs Q220, Q230 are no longer rendered non-conductive after the dead time period $T_D$. For example, the resistor R774 has a resistance of 4.7 kΩ, such that the dead time period $T_D$ is approximately 0.5 μsec.

During preheating of the lamp 102, the microcontroller 610 is operable to control the operation of the integrator 522 using the preheat control signal $V_{PRE}$. As shown in FIG. 10B, the preheat control signal $V_{PRE}$ is pulled up to the DC supply voltage $V_{CC}$ through a resistor R776 (e.g., having a resistance of 10 kΩ), and is coupled to the base of an NPN bipolar junction transistor Q778 through a resistor R780. For example, the resistors R776, R780 both have resistances of 10 kΩ. During preheating of the filaments of the lamp 102, the microcontroller 610 drives the preheat control signal $V_{PRE}$ high, such that transistor Q778 is rendered conductive. Accordingly, the capacitor C724 is operable to additionally charge in response to a current drawn through the transistor Q778 and a resistor R782 (e.g., having a resistance of 47 kΩ). The additional current allows the capacitor C724 to charge faster, and causes the integral control signal $V_{INT}$ to drop below the threshold voltage $V_{TH}$ more quickly. Thus, the control circuit 160 is operable to control the inverter circuit 140 to achieve the appropriate high-frequency switching of the FETs Q220, Q230 at the preheat frequency $f_{PRE}$ during preheating of the lamp 102.

The values of the components of the integrator may be chosen to optimize the operating frequency $f_{OP}$ when the ballast 100 is operating at low-end, i.e., at the maximum operating frequency during normal operation. As the control circuit 160 controls the intensity of the lamp 102 from low-end to high-end, the operating frequency $f_{OP}$ changes from the maximum operating frequency to a minimum operating frequency. Since the magnitude of the threshold voltage $V_{TH}$ is lowest when the ballast 100 is at high-end, the capacitor C724 charges for a longer period of time until the magnitude of the integral control signal $V_{INT}$ drops below the magnitude of the threshold voltage.

In order to ensure that the control circuit 160 controls the inverter circuit 140 to achieve the appropriate operating frequency $f_{OP}$ at high-end, the integrator 522 slows down the charging of the capacitor C724 near high-end. Specifically, the integrator 522 comprises two resistors R784, R786, which are coupled in series between the DC supply voltage $V_{CC}$ and circuit common, and a diode D788, coupled from the junction of the two resistors R784, R786 to the integral control signal $V_{INT}$. For example, the resistors R784, R786 have resistances of 3.3 kΩ and 8.2 kΩ, respectively, such that the current conducted through the diode D788 causes the capacitor C724 to charge slower if the magnitude of the integral control signal $V_{INT}$ drops below approximately 2.8 V.

Figure 11:
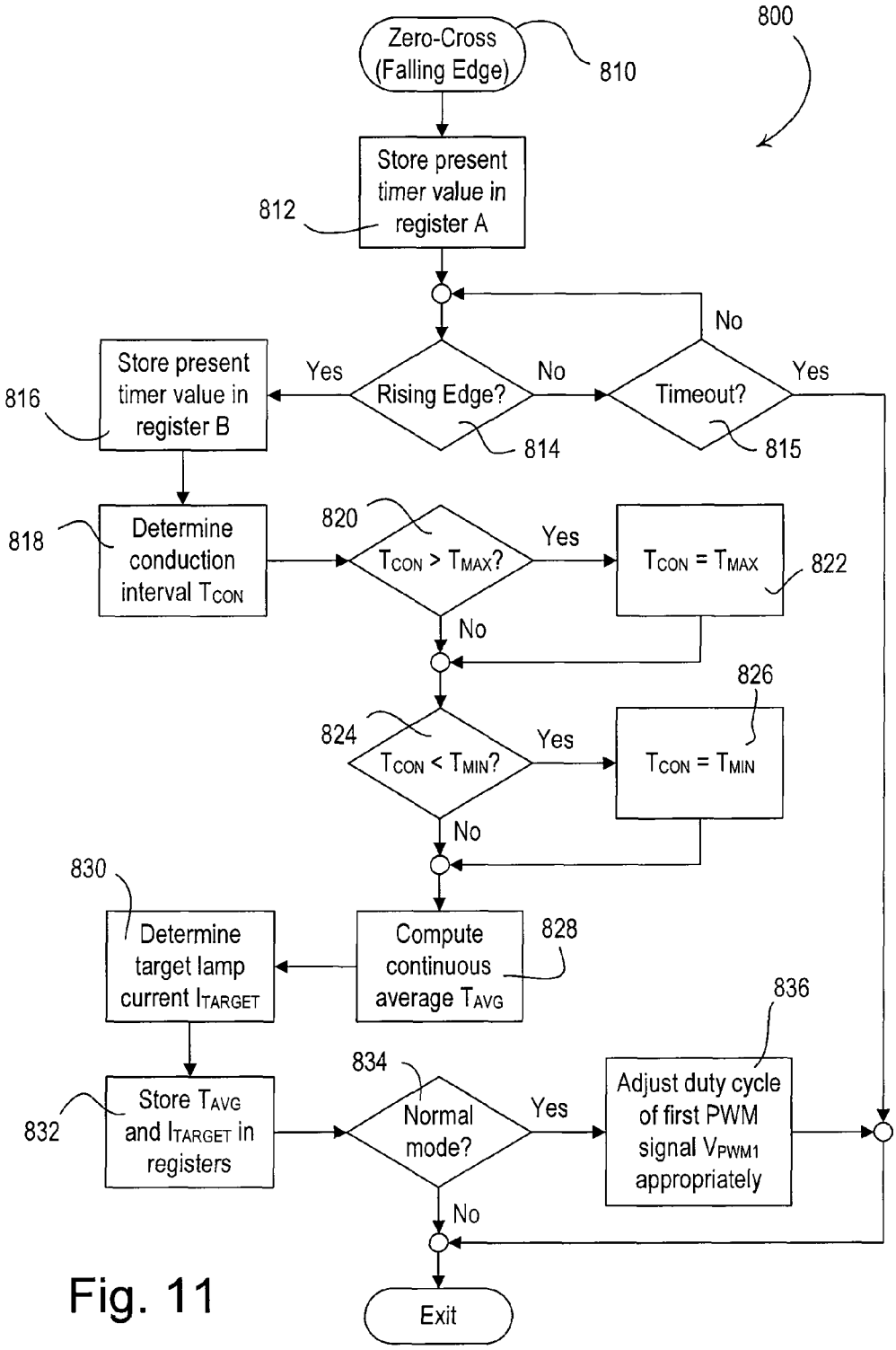
FIG. 11 is a simplified flowchart of a target lamp current procedure executed periodically by a microcontroller of the control circuit of FIG. 9.

FIG. 11 is a simplified flowchart of the target lamp current procedure 800 executed periodically by the microcontroller 610, e.g., once every half-cycle of the AC power source 102. The primary function of the target lamp current procedure 800 is to measure the conduction period $T_{CON}$ of the phase-controlled voltage $V_{PC}$ generated by the dimmer switch 104 and to determine the corresponding target lamp current $I_{TARGET}$ that will result in the desired intensity of the lamp 102. The microcontroller 610 uses a timer, which is continuously running, to measure the times of the rising and falling edges of the zero-crossing control signal $V_{ZC}$, and to calculate the difference between the times of the falling and rising edges to determine the conduction period $T_{CON}$ of the phase-control voltage $V_{PC}$.

The procedure 800 begins at step 810 in response to a falling-edge of the zero-crossing control signal $V_{ZC}$, which signals that the phase-control voltage $V_{PC}$ has risen above the zero-crossing threshold $V_{TH\text{-}ZC}$ of the zero-crossing detect circuit 162. The present value of the timer is immediately stored in register A at step 812. The microcontroller 610 waits for a rising edge of the zero-crossing signal $V_{ZC}$ at step 814 or for a timeout to expire at step 815. For example, the timeout may be the length of a half-cycle, i.e., approximately 8.33 msec if the AC power source operates at 60 Hz. If the timeout expires at step 815 before the microcontroller 610 detects a rising edge of the zero-crossing signal $V_{ZC}$ at step 814, the procedure 800 simply exits. When a rising edge of the zero-crossing control signal $V_{ZC}$ is detected at step 814 before the timeout expires at step 815, the microcontroller 610 stores the present value of the timer in register B at step 816. At step 818, the microcontroller 610 determines the length of the conduction interval $T_{CON}$ by subtracting the timer value stored in register A from the timer value stored in register B.

Next, the microcontroller 610 ensures that the measured conduction interval $T_{CON}$ is within predetermined limits. Specifically, if the conduction interval $T_{CON}$ is greater than a maximum conduction interval $T_{MAX}$ at step 820, the microcontroller 610 sets the conduction interval $T_{CON}$ equal to the maximum conduction interval $T_{MAX}$ at step 822. If the conduction interval $T_{CON}$ is less than a minimum conduction interval $T_{MIN}$ at step 824, the microcontroller 610 sets the conduction interval $T_{CON}$ equal to the minimum conduction interval $T_{MIN}$ at step 826.

At step 828, the microcontroller 610 calculates a continuous average $T_{AVG}$ in response to the measured conduction interval $T_{CON}$. For example, the microcontroller 610 may calculate a N:1 continuous average $T_{AVG}$ using the following equation:

$$T_{AVG}=(N\cdot T_{AVG}+T_{CON})/(N+1). \quad \text{(Equation 6)}$$

For example, N may equal 31, such that N+1 equals 32, which allows for easy processing of the division calculation by the microprocessor 610. At step 830, the microcontroller 610 determines the target lamp current $I_{TARGET}$ in response to the continuous average $T_{AVG}$ calculated at step 828, for example, by using a lookup table. The microcontroller 610 then stores the continuous average $T_{AVG}$ and the target lamp current $I_{TARGET}$ in separate registers at step 832. If the ballast 100 is in the normal operating mode at step 834 (i.e., the lamp 102 has been struck), the microcontroller 610 adjusts at step 836 the duty cycle of the first PWM signal $V_{PWM1}$ appropriately, such that the average magnitude of the first PWM signal is representative of the target lamp current $I_{TARGET}$ and the procedure 800 exits. If the ballast 100 is not in the normal operating mode at step 834 (i.e., the lamp 102 has not been struck or a fault condition exists), the procedure 800 simply exits.

Figure 12:
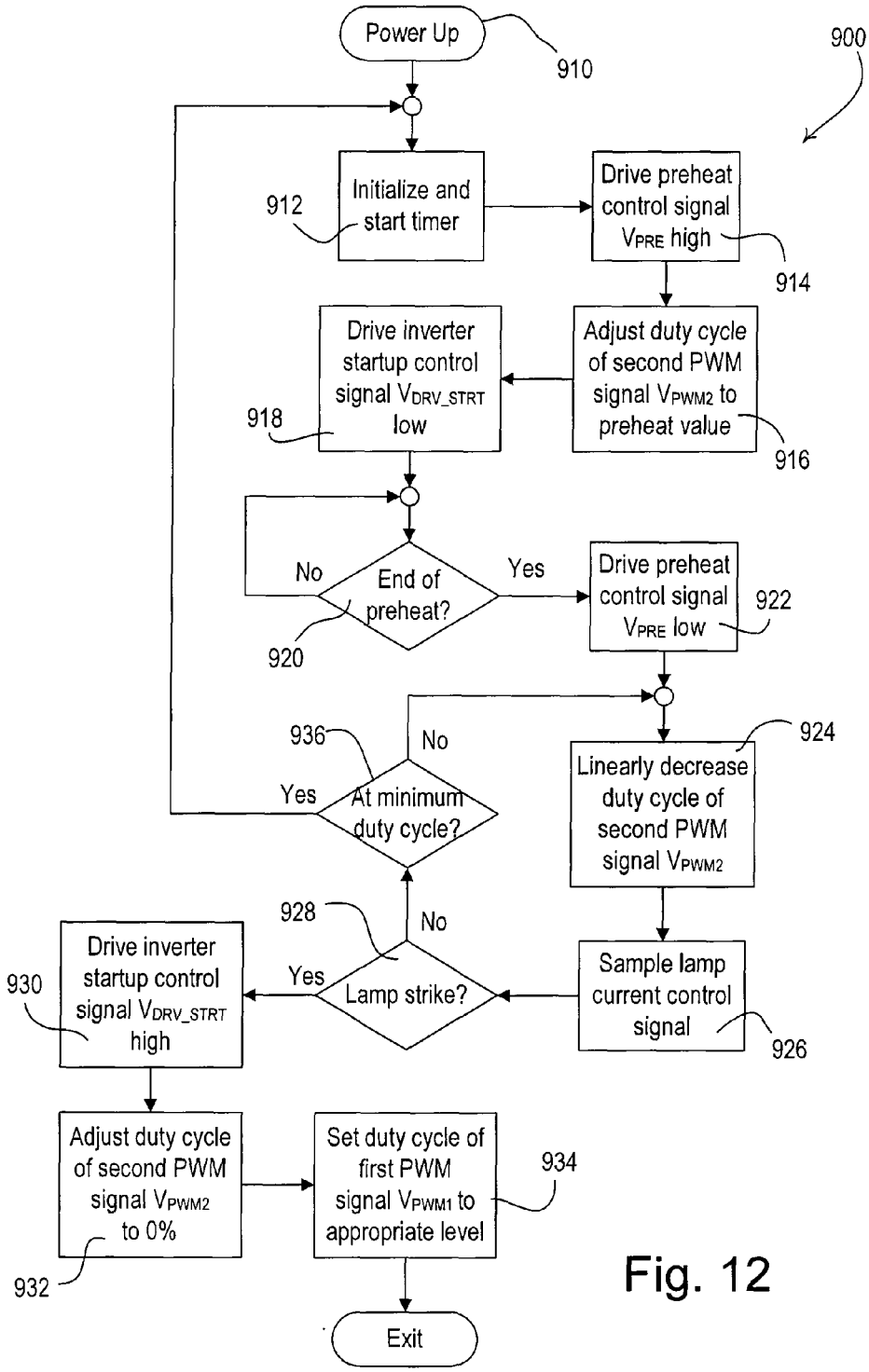
FIG. 12 is a simplified flowchart of a startup procedure executed by the microcontroller of the control circuit of FIG. 9.

FIG. 12 is a simplified flowchart of a startup procedure 900, which is executed by the microcontroller 610 when the microcontroller is first powered up at step 910. First, the microcontroller 610 initializes the timer to zero seconds and starts the timer at step 912. Next, the microcontroller 610 preheats the filaments of the lamp 102 during a preheat time period $T_{PRE}$. Specifically, the microcontroller 610 begins to preheat the filaments by driving the preheat control signal $V_{PRE}$ (which is provided to the integrator 822) high at step 914 and by adjusting the duty cycle of the second PWM signal $V_{PWM2}$ to a preheat value at step 916. At step 918, the microcontroller 610 drives the inverter startup control signal $V_{DRV_STRT}$ low, after the threshold voltage $V_{TH}$ has reached a steady state value in response to the second PWM signal $V_{PWM2}$ from step 916. As a result, the operating frequency $f_{OP}$ of the inverter circuit 140 is controlled to the preheat frequency $f_{PRE}$, such that the filaments windings 242 provide the proper filament voltages to the filaments of the lamp 102. The microcontroller 610 continues to preheat the filaments until the end of the preheat time period $T_{PRE}$ at step 920.

After the preheat time period $T_{PRE}$, the microcontroller 610 drives the preheat control signal $V_{PRE}$ low at step 922 and linearly decreases the duty cycle of the second PWM signal $V_{PWM2}$ at step 924, such that the resulting operating frequency $f_{OP}$ of the inverter circuit 140 decreases from the preheat frequency $f_{PRE}$ until the lamp 102 strikes. At step 926, the microcontroller 610 samples the lamp current control signal $V_{LAMP_CUR}$ to determine if the lamp current $I_{LAMP}$ is flowing through the lamp 102 and the lamp has been struck. If the lamp has been struck at step 928, the microcontroller 610 drives the inverter startup control signal $V_{DRV_STRT}$ high at step 930 and adjusts the duty cycle of the second PWM signal $V_{PWM2}$ to zero percent at step 932, such that the resulting override voltage $V_{OVERRIDE}$ has a magnitude of approximately zero volts and does not affect the operation of the PI controller 516.

While the startup procedure 900 is executing, the target lamp current procedure 800 is also being executed each half-cycle of the AC power source 104, such that the target lamp current $I_{TARGET}$ has been determined and stored in a register.

At step 934 of the startup procedure 900, the microcontroller 610 sets the duty cycle of the first PWM signal $V_{PWM1}$ to the appropriate level, before the startup procedure 900 exits and the ballast begins normal operation.

If the lamp has not been struck at step 928 and the duty cycle has not been decreased to a minimum duty cycle at step 936, the microcontroller 610 continues to linearly decrease the duty cycle of the second PWM signal $V_{PWM2}$ at step 924. If the lamp has not been struck at step 928, but the duty cycle has reached a minimum duty cycle at step 936, the procedure 900 loops around, such that the microcontroller 610 starts over and attempts to preheat and strike the lamp 102 once again.

As previously mentioned, the dimmer switch 106 of FIG. 1 typically includes a bidirectional semiconductor switch, such as a triac, for generating the phase-controlled voltage $V_{PC}$. When a typical triac is conductive, the current conducted by the triac must remain above a holding current rating of the triac for the triac to remain conductive. Therefore, when a dimmer switch 106 is coupled in series with a two-wire ballast (as shown in FIG. 1), the two-wire ballast must draw enough current to maintain the triac conductive and to ensure proper operation of the dimmer switch.

Figure 13:
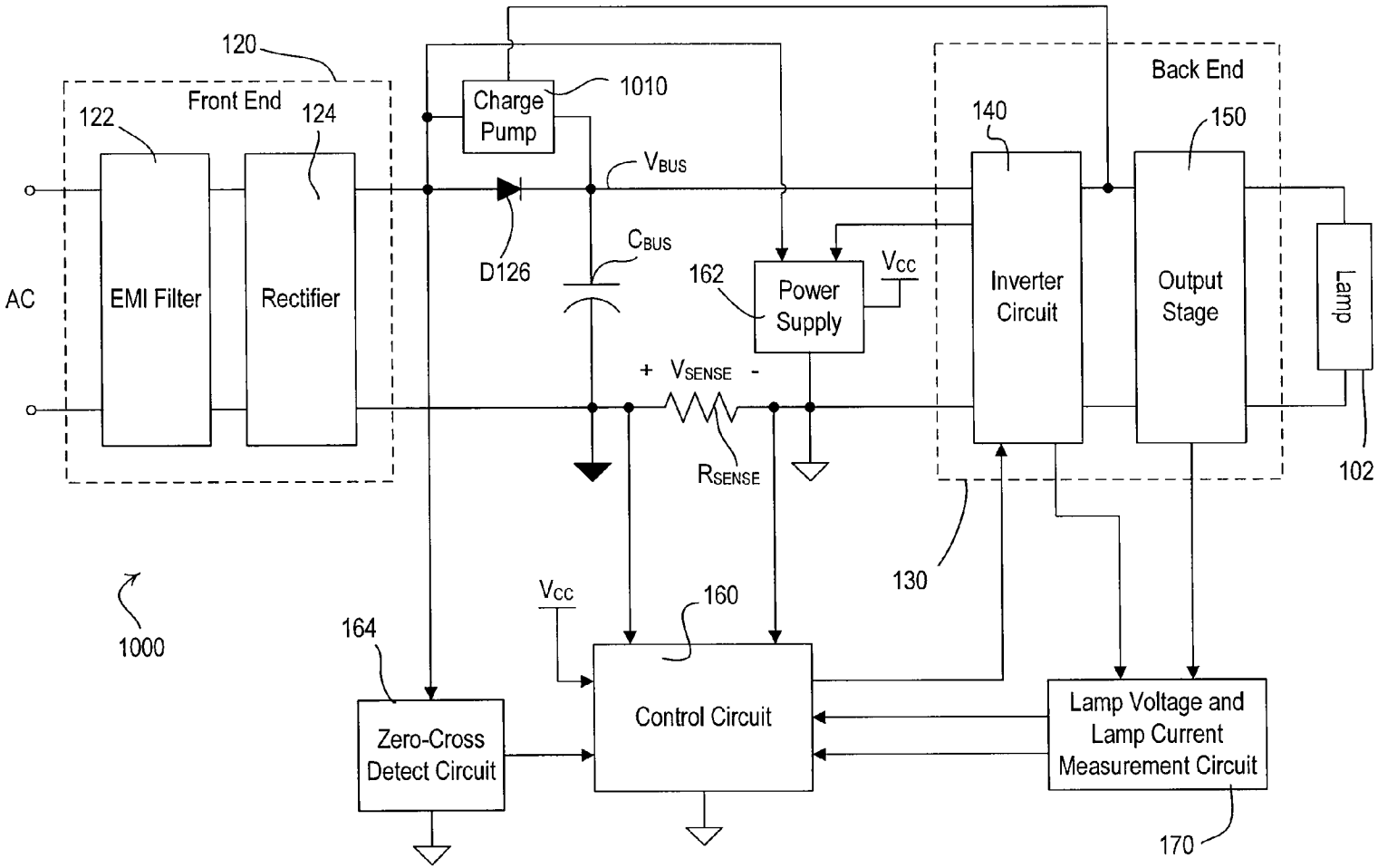
FIG. 13 is a simplified block diagram of an electronic dimming ballast according to a second embodiment of the present invention.

FIG. 13 is a simplified block diagram of an electronic dimming ballast 1000 according to a second embodiment of the present invention. The electronic dimming ballast 1000 comprises a charge pump circuit 1010, which is coupled in parallel electrical connection the diode D126 between the rectifier 124 and the inverter circuit 140. When the magnitude of the rectified voltage $V_{RECT}$ is less than the magnitude of the bus voltage $V_{BUS}$, the charge pump circuit 1010 operates to draw a charge current $I_{CP}$ from the AC power source 104. Specifically, the charge pump circuit 1010 is coupled to the output of the inverter circuit 140, such that the charge pump circuit 1010 is operable to draw the charge current $I_{CP}$ every other half-cycle of the square-wave voltage $V_{SQ}$. The charge current $I_{CP}$ drawn during the times that the magnitude of the rectified voltage $V_{RECT}$ is less than the magnitude of the bus voltage $V_{BUS}$ helps to prevent the current through the triac of the dimmer switch 106 from dropping below the holding current rating.

Figure 14:
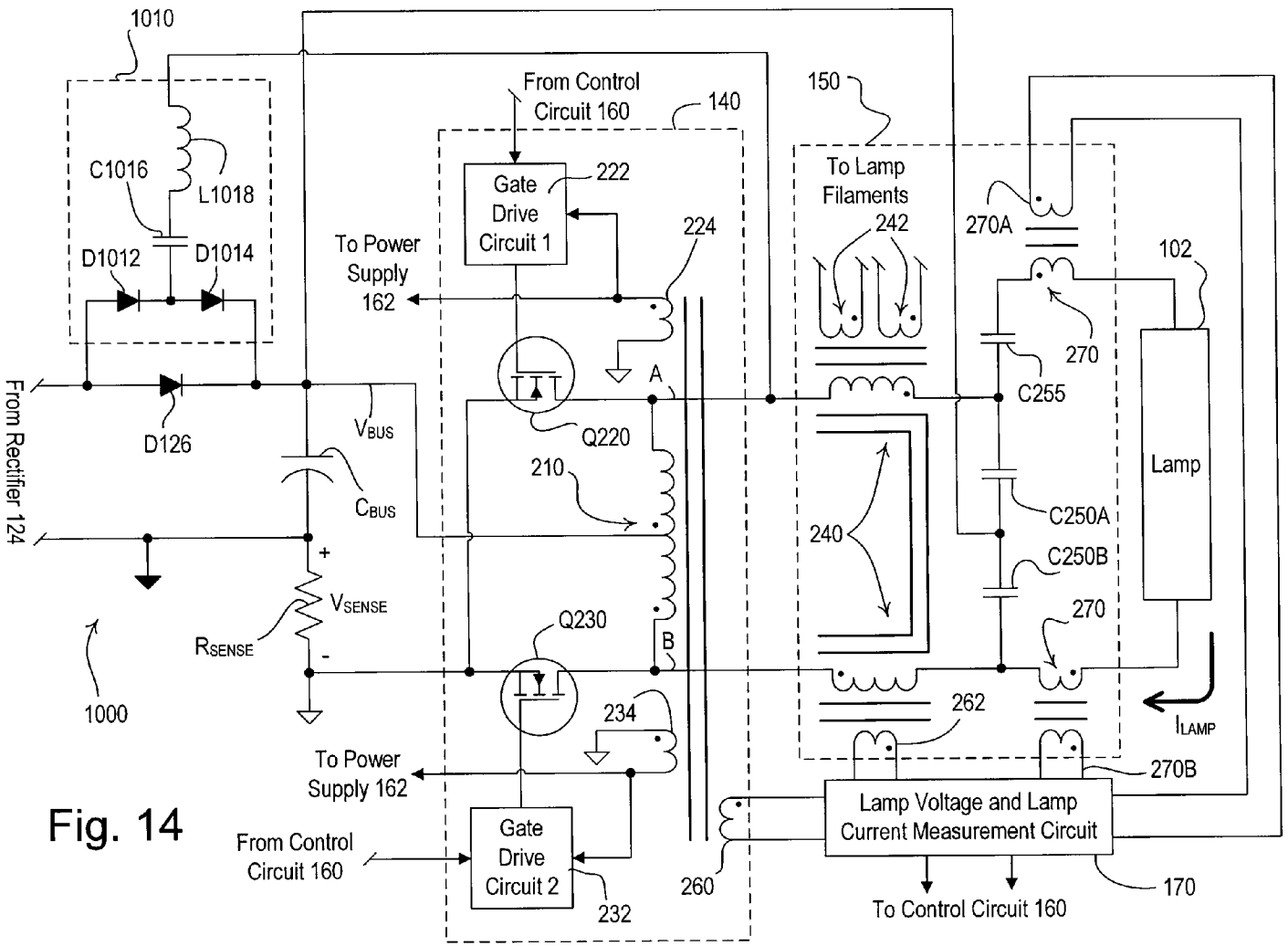
FIG. 14 is a simplified schematic diagram showing a charge pump, an inverter circuit, and a resonant tank circuit of the ballast of FIG. 13 in greater detail.

FIG. 14 is a simplified schematic diagram showing the charge pump 1010 in greater detail. The charge pump 1010 comprises two diodes D1012, D1014 connected in series across the diode D126. The charge pump 1010 further comprises a capacitor C1016 and an inductor L1018, which are coupled in series between the junction of the diodes D1012, D1014 and the output of the inverter circuit 140 at the junction of the main transformer 210 and the first FET Q220 (i.e., node A as shown in FIG. 14). For example, the capacitor C1016 may have a capacitance of 0.01 μF, while the inductor L1018 may have an inductance of 600 μH.

When the magnitude of the rectified voltage $V_{RECT}$ is greater than the magnitude of the bus voltage $V_{BUS}$, the diode D126 is conductive as the bus capacitor $C_{BUS}$ charges. However, when the magnitude of the rectified voltage $V_{RECT}$ is less than the magnitude of the bus voltage $V_{BUS}$ and the first FET Q220 is conductive, the capacitor C1016 is operable to charge through the diode D1012, thus drawing the charge current $I_{CP}$ through the dimmer switch 106. The capacitor C1016 charges to approximately the instantaneous magnitude of the line voltage.

When the first FET Q220 is non-conductive and the voltage across the primary winding of the main transformer 210 has a magnitude of approximately twice the bus voltage (i.e., $2 \cdot V_{BUS}$), the capacitor C1016 charges to approximately the magnitude of the bus voltage $V_{BUS}$ and conducts an additional bus charging current $I_{BUS}$ through the diode D1014 and into the bus capacitor $C_{BUS}$. Accordingly, while the magnitude of the rectified voltage $V_{RECT}$ is less than the magnitude of the bus voltage $V_{BUS}$, the charge pump 1010 operates to periodically draw the charge current $I_{CP}$ through dimmer switch 106 and to conduct the additional bus charging current $I_{BUS}$ into the bus capacitor $C_{BUS}$ to allow the bus capacitor $C_{BUS}$ to charge during a time when the bus capacitor $C_{BUS}$ would normally be decreasing in charge. The inductor L1018 controls the rate at which the voltage across the capacitor C1016 changes in response to the changing voltage across the output of the inverter circuit 140.

Figure 15:
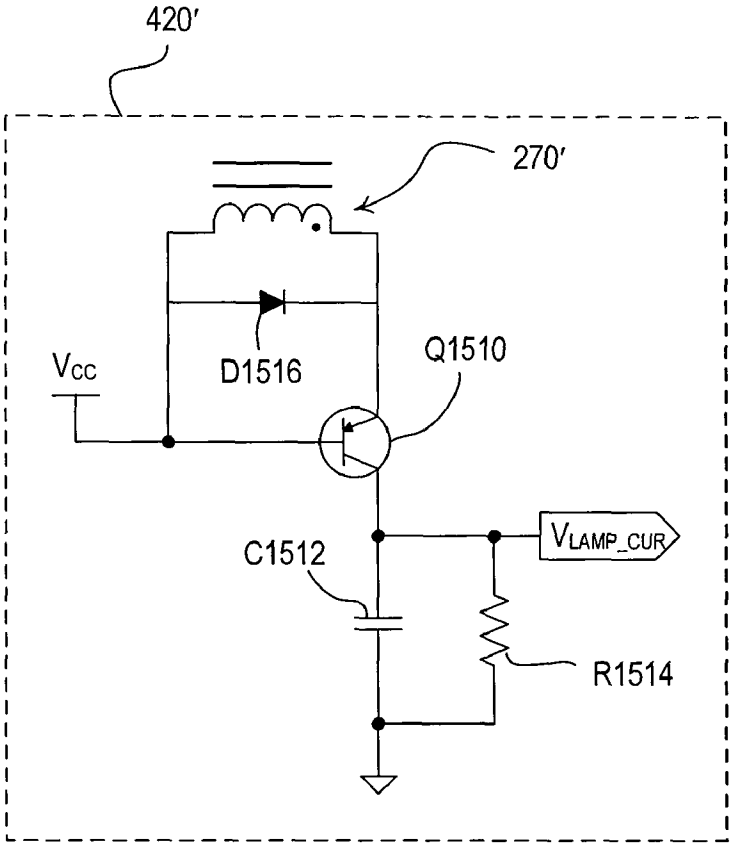
FIG. 15 is a simplified schematic diagram of a lamp current measurement circuit of the measurement circuit of FIG. 7 according to a third embodiment of the present invention.

FIG. 15 is a simplified schematic diagram of a lamp current measurement circuit 420' of the measurement circuit 170 according to a third embodiment of the present invention. A current transformer 270' has two primary winding coupled between the resonant tank circuit 150 and to the lamp 102 as shown in FIG. 4. However, the current transformer 270' only has a single secondary winding coupled to the lamp current measurement circuit 420'. Specifically, the secondary winding of the current transformer 270' is coupled across the base-emitter junction of a PNP bipolar junction transistor Q1510. The junction of the base of the transistor Q1510 and the secondary winding of the current transformer 270' is coupled to the DC supply voltage $V_{CC}$. When the lamp current $I_{LAMP}$ (and thus the current through the secondary winding of the current transformer 270') has a positive magnitude, the transistor Q1510 is rendered conductive, thus conducting current through a capacitor C1512 and a resistor R1514. The lamp current control signal $V_{LAMP_CUR}$ generated across the parallel combination of the capacitor C1512 and the resistor R1514 is representative of the magnitude of the lamp current $I_{LAMP}$. When the lamp current $I_{LAMP}$ has a negative magnitude, the transistor Q1510 is non-conductive, and the current through the secondary winding of the current transformer 270' flows through a diode D1516.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. An electronic ballast for driving a gas discharge lamp having first and second electrodes, such that a lamp current flows from the first electrode to the second electrode the lamp and a lamp voltage is produced across the lamp, the ballast comprising:

an inverter circuit operable to convert a substantially DC bus voltage to a high-frequency AC voltage;

a resonant tank circuit having an output and operable to couple the high-frequency AC voltage to the lamp;

a current transformer having first and second primary windings, and first and second secondary windings magnetically coupled to the first and second primary windings, the first primary winding adapted to be coupled in series electrical connection between the output of the resonant tank circuit and the first electrode of the lamp, the second primary winding adapted to be coupled in series electrical connection between the output of the resonant tank circuit and the second electrode of the lamp, the first and second primary windings coupled such that differential-mode currents in the electrodes are added and common-mode currents in the electrodes are subtracted, the first and second secondary windings operable to conduct respective first and second currents representative of the lamp current; and a lamp current measurement circuit coupled to the first and second secondary windings of the current transformer, the lamp current measurement circuit comprising a capacitor coupled such that the first current of the first secondary winding of the current transformer flows into the capacitor when the magnitude of the lamp current is positive, and the second current of the second secondary winding of the current transformer flows out of the capacitor when the magnitude of the lamp current is negative, the capacitor only conducting the first and second currents of the first and second secondary windings during every other half-cycle of the lamp voltage;

wherein a voltage produced across the capacitor is representative of the magnitude of the lamp current that is in-phase with the lamp voltage.

2. The ballast of claim 1, wherein the lamp current measurement circuit comprises a first semiconductor switch adapted to conduct the first current of the first secondary winding of the current transformer into the capacitor, and a second semiconductor switch adapted to conduct the second current of the second secondary winding of the current transformer from the capacitor.

3. The ballast of claim 2, wherein the lamp current measurement circuit comprises a third semiconductor switch coupled such that the first and second semiconductor switches are rendered conductive when the third semiconductor switch is conductive, the third semiconductor switch having a control input coupled to receive a first voltage having a magnitude representative of the lamp voltage.

4. The ballast of claim 3, wherein the lamp current measurement circuit comprises a first bipolar junction transistor having a base-emitter junction coupled across the first secondary winding of the current transformer, such that the first transistor is operable to be rendered conductive to conduct the first current through the first semiconductor switch into the capacitor when the magnitude of the lamp current is positive; and wherein the lamp current measurement circuit comprises a second bipolar junction transistor having a base-emitter junction coupled across the second secondary winding of the current transformer, such that the second transistor is operable to be rendered conductive to conduct the second current from the capacitor through the second semiconductor switch when the magnitude of the lamp current is negative.

5. The ballast of claim 4, further comprising:

a first winding magnetically coupled to a primary winding of a main transformer of the inverter circuit; and a second winding magnetically coupled to a resonant inductor of the resonant tank circuit;

wherein the first and second windings are coupled together to generate the first voltage representative of the lamp voltage.

6. The ballast of claim 4, wherein the third semiconductor switch is operable to become conductive during the positive half-cycles of the lamp voltage, such that the capacitor conducts the first and second currents of the first and second secondary windings only during the positive half-cycles of the lamp voltage.

7. A lamp current measurement circuit for an electronic ballast for driving a gas discharge lamp having first and second electrodes, such that a lamp current flows from the first electrode to the second electrode the lamp and a lamp voltage is produced across the lamp, the ballast comprising an inverter circuit operable to convert a substantially DC bus voltage to a high-frequency AC voltage, and a resonant tank circuit having an output and operable to couple the high-frequency AC voltage to the lamp, the lamp current measurement circuit comprising:

a current transformer having first and second primary windings, and first and second secondary windings magnetically coupled to the first and second primary windings, the first primary winding adapted to be coupled in series electrical connection between the output of the resonant tank circuit and the first electrode of the lamp, the second primary winding adapted to be coupled in series electrical connection between the output of the resonant tank circuit and the second electrode of the lamp, the first and second primary windings coupled such that differential-mode currents in the electrodes are added and common-mode currents in the electrodes are subtracted, the first and second secondary windings operable to conduct respective first and second currents representative of the lamp current; and a capacitor coupled to conduct the first and second currents of the first and second secondary windings of the current transformer, such that the first current flows into the capacitor when the lamp current is positive, and the second current flows out of the capacitor when the lamp current is negative, the capacitor only conducting the first and second currents of the first and second secondary windings during every other half-cycle of the lamp voltage;

wherein a voltage produced across the capacitor is representative of the magnitude of the lamp current that is in-phase with the lamp voltage.

8. The lamp current measurement circuit of claim 7, further comprising:

a first semiconductor switch adapted to conduct the first current of the first secondary winding of the current transformer into the capacitor; and a second semiconductor switch adapted to conduct the second current of the second secondary winding of the current transformer from the capacitor.

9. The lamp current measurement circuit of claim 8, further comprising:

a third semiconductor switch coupled such that the first and second semiconductor switches are rendered conductive when the third semiconductor switch is conductive, the third semiconductor switch having a control input coupled to receive a first voltage having a magnitude representative of the lamp voltage.

10. The lamp current measurement circuit of claim 9, further comprising:

a first bipolar junction transistor having a base-emitter junction coupled across the first secondary winding of the current transformer, such that the first transistor is operable to be rendered conductive to conduct the first current through the first semiconductor switch into the capacitor when the magnitude of the first current of the first secondary winding is positive; and a second bipolar junction transistor having a base-emitter junction coupled across the second secondary winding of the current transformer, such that the second transistor is operable to be rendered conductive to conduct the second current from the capacitor through the second semiconductor switch when the magnitude of the second current of the second secondary winding is negative.

11. The lamp current measurement circuit of claim 10, wherein the first, second, and third semiconductors switches comprise bipolar junction transistors; and wherein the bipolar junction transistors of the lamp current measurement circuit are prevented from operating in the saturation region.

12. The lamp current measurement circuit of claim 10, further comprising:

a fourth semiconductor switch coupled to the first bipolar junction transistor to prevent the first bipolar junction transistor from operating in the saturation region when the first bipolar junction transistor begins to conduct the first current through the first semiconductor switch into the capacitor.

13. A method of measuring a lamp current in an electronic ballast for driving a gas discharge lamp having first and second electrodes, the lamp current flowing through the lamp, the method comprising the steps of:

measuring a first current in the first electrode of the lamp;

measuring a second current in the second electrode of the lamp;

adding the first and second currents in such a way that differential-mode currents in the electrodes are added and common-mode currents in the electrodes are subtracted; and determining the lamp current in response to the step of adding the first and second currents, the lamp current not dependent upon the common-mode currents.

14. The method of claim 13, further comprising the step of:

integrating the sum of the first and second currents to generate a lamp current control signal representative of the magnitude of the lamp current.

15. The method of claim 14, further comprising the step of:

receiving a voltage representative of the magnitude of a lamp voltage measured across the lamp;

wherein the step of integrating further comprises integrating the sum of the first and second currents during every other half-cycle of the lamp voltage.

16. The method of claim 15, wherein the step of integrating comprises steering the first current into a capacitor when the magnitude of the first current is positive, and steering the second current into the capacitor when the magnitude of the second current is negative.

17. An electronic ballast for driving a gas discharge lamp, said ballast comprising:

a bus capacitor connected across a DC bus voltage;

an inverter circuit for receiving said DC bus voltage and for generating a substantially square-wave voltage having a magnitude approximately twice said DC bus voltage, said inverter circuit comprising a transformer having a primary winding comprising first and second winding portions connected at a center tap and having first and second terminals, said bus capacitor being connected between a common point and said center tap, said inverter circuit further comprising first and second switches coupled between said common point and said respective first and second terminals of said primary winding, and a control circuit for controlling the conduction state of said first and second switches, said control circuit providing first and second control signals to control inputs of said first and second switches, respectively, whereby said first and second switches are alternately rendered conductive to generate said substantially square wave voltage across said primary winding;

a resonant tank circuit for receiving said square-wave voltage and generating a substantially sinusoidal voltage for driving said lamp; and a measurement circuit for determining the magnitude of the current flowing from said inverter circuit to said lamp;

wherein said measurement circuit senses said lamp current during alternate half-cycles of said lamp current, thereby measuring only a real component of said lamp current and ignoring a reactive component.

18. The ballast of claim 17, wherein said measurement circuit includes an integrating circuit integrating said lamp current thereby integrating said reactive component of said lamp current to zero and measuring only said real component.

19. The ballast of claim 17, wherein said control circuit comprises:

a circuit receiving an input from said measurement circuit for monitoring said lamp current to determine if there is an overcurrent condition;

wherein said control circuit provides an override signal to said controller circuit to force said controller circuit to provide a predetermined safe output signal in the event of an overcurrent condition.

20. An electronic ballast for driving a gas discharge lamp, the ballast comprising:

an inverter circuit operable to convert a substantially DC bus voltage to a high-frequency AC voltage provided at an output of the inverter circuit, the inverter circuit including a main transformer having a primary winding coupled across the output of the inverter circuit;

a resonant tank circuit operable to couple the high-frequency AC voltage to the lamp, the resonant tank circuit including a resonant inductor adapted to be coupled between the output of the inverter circuit and the lamp;

a first winding magnetically coupled to the primary winding of the main transformer of the inverter circuit, the first winding operable to generate a first voltage representative of the magnitude of the high-frequency AC voltage at the output of the inverter circuit; and a second winding magnetically coupled to the resonant inductor of the resonant tank circuit, the second winding operable to generate a second voltage representative of the magnitude of a voltage across the resonant inductor;

wherein the first and second windings are coupled in series to generate a third voltage representative of the lamp voltage measured across the lamp.

21. The electronic ballast of claim 20, further comprising:

a lamp voltage measurement circuit coupled across the series combination of the first and second windings for receipt of the third voltage.

22. The electronic ballast of claim 21, wherein the lamp voltage measurement circuit is operable to generate a lamp voltage control signal representative of the third voltage.

23. A method of measuring a lamp voltage in an electronic ballast for driving a gas discharge lamp having first and second electrodes, the lamp voltage measured across the first and second electrodes of the lamp, the ballast comprising an inverter circuit operable to convert a substantially DC bus voltage to a high-frequency AC voltage provided across a primary winding of a transformer, and a resonant tank circuit operable to couple the high-frequency AC voltage to the lamp and including a resonant inductor adapted to be coupled between the primary winding of the transformer of the inverter circuit and the lamp, the method comprising the steps of:

magnetically coupling a first winding to the primary winding of the transformer of the inverter circuit;

magnetically coupling a second winding to the resonant inductor of the resonant tank circuit;

generating a first voltage across the first winding, the first voltage representative of the magnitude of the high-frequency AC voltage of the inverter circuit;

generating a second voltage across the second winding, the second voltage representative of the magnitude of a voltage across the resonant inductor; and electrically connecting the first and second windings so as to add the first and second voltages to produce a third voltage representative of a lamp voltage measured across the lamp.

24. An electronic ballast for driving a gas discharge lamp, said ballast comprising:

a bus capacitor connected across a DC bus voltage;

an inverter circuit for receiving said DC bus voltage and for generating a substantially square-wave voltage having a magnitude approximately twice said DC bus voltage, said inverter circuit comprising a transformer having a primary winding comprising first and second winding portions connected at a center tap and having first and second terminals, said bus capacitor being connected between a common point and said center tap, said inverter circuit further comprising first and second switches coupled between said common point and said respective first and second terminals of said primary winding, and a control circuit for controlling the conduction state of said first and second switches, said control circuit providing first and second control signals to control the conduction of said first and second switches, respectively, whereby said first and second switches are alternately rendered conductive to generate said substantially square wave voltage across said primary winding;

a resonant tank circuit for receiving said square-wave voltage and generating a substantially sinusoidal voltage for driving said lamp; and a measurement circuit for determining the magnitude of a lamp voltage across said lamp, said measurement circuit determining the magnitude of said lamp voltage by sensing said square-wave voltage and a voltage across said resonant inductor, and determining the magnitude of said lamp voltage as a difference between the magnitude of said square-wave voltage and the magnitude of said voltage across said resonant inductor.

25. The ballast of claim 24, wherein said transformer has an auxiliary winding for sensing the magnitude of said square-wave voltage, and said resonant inductor has an auxiliary winding for sensing said voltage across said resonant inductor, said measurement circuit being coupled to said auxiliary windings thereby to determine the magnitude of said lamp voltage across said lamp.

26. The ballast of claim 25, further comprising:

a current sensing device for determining said lamp current coupled to said measurement circuit.

27. The ballast of claim 26, wherein said current sensing device comprises a current transformer coupled in series with said lamp.

28. The ballast of claim 27, wherein said current sensing device comprises a current transformer having first and second primary windings coupled in series with said lamp, said current transformer having first and second secondary windings coupled to said measurement circuit for providing a signal representative of said lamp current.

29. The ballast of claim 28, wherein said first and second primary windings of said current transformer are coupled to said lamp so that differential mode currents flowing in said lamp are added and common mode currents are canceled.

30. The ballast of claim 24, wherein said control circuit comprises:

a circuit receiving an input from said measurement circuit and monitoring said lamp voltage and determining if there is an overvoltage condition;

wherein said control circuit provides an override signal to said controller circuit to force said controller circuit to provide a predetermined safe output signal in the event of an overvoltage condition.

* * * * *